US005594480A

United States Patent [19]

Sato et al.

[11] Patent Number: 5,594,480

[45] Date of Patent: Jan. 14, 1997

[54] PRINTING DEVICE AND PHOTOGRAPHIC PAPER

[75] Inventors: Shuji Sato, Kanagawa; Masanori Ogata, Saitama; Kengo Ito, Kanagawa; Hiroyuki Shiota, Chiba, all of Japan

[73] Assignee: Sony Corporation, Tokyo, Japan

[21] Appl. No.: 134,677

[22] Filed: Oct. 12, 1993

[30] Foreign Application Priority Data

| | | | |
|---|---|---|---|
| Oct. 14, 1992 | [JP] | Japan | 4-300587 |
| Oct. 14, 1992 | [JP] | Japan | 4-300588 |
| Oct. 15, 1992 | [JP] | Japan | 4-277165 |

[51] Int. Cl.[6] ..... B41J 2/14

[52] U.S. Cl. ..... 347/51; 347/61; 347/88; 503/227

[58] Field of Search ..... 347/51, 55, 61, 347/88, 93; 503/227

[56] References Cited

U.S. PATENT DOCUMENTS

| | | | |
|---|---|---|---|
| 3,177,800 | 4/1965 | Welsh | 347/61 |
| 3,838,431 | 9/1974 | Germer | 346/76 |
| 3,958,253 | 5/1976 | Rueckmann | 346/76 |
| 4,275,290 | 6/1981 | Cielo et al. | 347/61 |
| 4,312,009 | 1/1982 | Lange | 346/140 |
| 4,682,187 | 7/1987 | Martner | 347/88 |
| 4,740,809 | 4/1988 | Yamamoto et al. | 355/27 |
| 4,875,059 | 10/1989 | Masuda | 347/93 |
| 4,876,235 | 10/1989 | DeBoer | 503/227 |
| 4,965,610 | 10/1990 | Ishikawa | 347/61 |
| 5,021,808 | 6/1991 | Kohyama | 347/66 |

FOREIGN PATENT DOCUMENTS

| | | |
|---|---|---|
| 0263381 | 9/1987 | European Pat. Off. . |
| 0284282A3 | 9/1988 | European Pat. Off. . |

OTHER PUBLICATIONS

EPO Search Report.

IBM Technical Disclosure Bullentin, vol. 18, No. 12, May 1976.

*Primary Examiner*—John E. Barlow, Jr.

*Attorney, Agent, or Firm*—Ronald P. Kananen

[57] ABSTRACT

A printing device includes a dye tank for containing a powdered vaporizable dye, an entrance section for liquefying the powdered vaporizable dye and a vaporizing section for radiating a laser light beam onto the liquefied dye transported thereto by the entrance section and vaporizing the dye for thermal transcription onto a photographic paper. The photographic paper includes a light absorbing layer between a receptor layer and a photographic paper base. Since the light absorbing layer is capable of absorbing the light efficiently for evolving heat efficiently, the receptor layer may be heated directly to assure high quality printing.

9 Claims, 15 Drawing Sheets

PRINTING DEVICE AND PHOTOGRAPHIC PAPER

BACKGROUND OF THE INVENTION

1. Field of the Invention

This invention relates to a printing device for printing a still picture, such as a picture formed by a video camera or a still television picture, using a vaporized dye, and a photographic paper on which printing is made by such printing device.

2. Description of the Related Art

There has hitherto been known a printing device, such as a sublimation printer, in which a sublimation ink ribbon, coated with a sublimable dye, is superposed on the photographic paper, and electric energy corresponding to the picture information is applied to a thermal head for subliming the dye on the ink ribbon under a heat energy supplied from the thermal head and for transcribing the sublimed dye onto the photographic paper.

The sublimation ink ribbon is prepared by dissolving a sublimable dye in a solution of acetate or polyester for example, and adding a dispersant to the resulting solution to form a colloidal dispersion in the form of an ink which is mixed with a binder and subsequently coated on a base paper.

The photographic paper usually includes a receptor layer of a heat transfer recording material on a photographic base paper. Among the heat transcription recording materials in current use is a dye-like resin, such as polyester or polycarbonate resin, admixed with a lubricant.

The thermal head is a device which translates an electrical energy into a heat energy, that is a device in which the dye is sublimed from the sublimation ink ribbon by heat generated by a current flowing through a resistor, and transcribed onto the photographic paper.

When the recording picture is formed on the photographic paper by the above-mentioned sublimation ink ribbon and thermal head, the receptor layer of the photographic paper undergoes the following changes:

That is, when the heat energy is applied from the thermal head, the polyester resin, for example, of the receptor layer undergoes glass transition and softening and thereby turned into the liquid, at the same time that the dye in the sublimation ink ribbon is transferred onto the receptor layer so as to be dissolved or dispersed in the layer to form the recording picture.

With the above-described sublimation printer, in which printing is made on the photographic paper using the sublimation ink ribbon and the thermal head, it is necessary to provide an ink ribbon takeup mechanism for rewinding the ink ribbon and a heat radiating mechanism for the thermal head. Additionally, the thermal head usually has a heat conversion efficiency of not higher than 10%, thus leading to considerable power consumption. Thus it has been difficult with the conventional sublimation type printer to realize saving in power and a reduction in size and costs.

Further, the sublimation ink ribbon can be used only once for each picture and hence is not economical. Besides, the used-up ink ribbon cassette can not be regenerated (recycled) and hence must be discarded in a manner which will not destroy the earth's environment.

Besides, the printing by such printing device is carried out by stacking dyes of yellow (Y), magenta (M) and cyan (C), so that it becomes necessary to cyclically perform three complicated and time-consuming operations including feeding the ink ribbon, vertically moving the thermal head and feeding the photographic paper.

The thermal head generally includes a line-head structure comprised of aligned thin resistors generated by sputtering. This effects the size of the printing paper and induces the problem that is cannot be set freely.

Since it is generally desirable to heat the receptor layer on the photographic paper when subliming and transcribing the sublimable dye onto the photographic paper by the thermal head, it has been a conventional practice to increase the force with which the thermal head is thrust against the paper to improve the contact between the ink ribbon and the photographic paper and the application of heat to the receptor layer of the photographic paper by the thermal head. It should be noted that, if the force with which the thermal head is thrust against the ink ribbon and the photographic paper is increased, the driving force necessary for the movement of the thermal head, rewinding of the ink ribbon and the feed of the photographic paper has to be correspondingly increased. In addition, since the ink ribbon is prepared by coating the dye processed into an ink on the base paper, as described above, the heat reaches the receptor layer via the base paper and the dye layer. Besides, since air layers tend to be produced between the respective layers, the heat to be applied to the receptor layer needs to be set to take account of heat losses produced in each layer which lower the heat efficiency.

Further, the produced picture tends to be lowered in quality if the photographic paper is not whitened at least directly after printing.

OBJECTS AND SUMMARY OF THE INVENTION

In view of the above-described status of the art, it is an object of the present invention to provide a printing device in which power savings and a reduction in size and costs may be realized without employing a thermal head or an ink ribbon. It is another object of the present invention to provide a printing device in which the printing time may be shortened and the printing paper size may be freely set to assure high picture quality.

It is a further object of the present invention to provide a photographic paper having a receptor layer which may be heated efficiently by the printing device to assure high picture quality of the printed picture.

According to the present invention, there is provided a printing device for thermal transcription of a vaporizable dye onto a photographic paper comprising a dye tank for containing a vaporizable dye, an entrance section for liquefying the vaporizable dye contained in the dye tank and transporting the vaporized dye, and a vaporizing section for vaporizing the liquefied dye transported by the entrance section, wherein the dye vaporized by the vaporizing section is thermally transcribed onto the photographic paper.

Preferably, the vaporizable dye contained in the dye tank is powdered.

Preferably, the vaporizing section vaporizes the liquefied dye transported by the entrance section by the heat of vaporization generated responsive to a laser light.

Preferably, the laser light employed for generating the heat of vaporization in the vaporizing section is a laser light having equalized radiation intensity distribution.

Preferably, a region from the dye tank to the vaporizing section is maintained at a temperature of 50° C. to 300° C.

Preferably, the entrance section transports the liquefied dye to the vaporizing section by taking advantage of a capillary phenomenon.

Also preferably, the vaporizing section causes the vaporized dye to be deposited on the photographic paper by taking advantage of a diffusion phenomenon produced with the aid of beads.

According to the present invention, there is also provided a printing device for thermal transcription of a vaporizable dye onto a photographic paper comprising a containing section for containing a vaporizable dye, a supplying section for supplying the vaporizable dye supplied from the containing section, and a vaporizing section for vaporizing the vaporizable dye supplied by the supplying section under the heat of vaporization, wherein the vaporizable dye vaporized by the vaporizing section is thermally transcribed onto the photographic paper.

Preferably, the vaporizable dye contained in the containing section is a particulate vaporizable dye and the vaporizable dye supplied by the supplying section to the vaporizing section is also a particulate vaporizable dye.

Preferably, the vaporizable dye contained in the containing section is the vaporizable dye deposited on spherical-shaped bodies and the vaporizable dye supplied by the supplying section is also a vaporizable dye deposited on spherical-shaped bodies.

Preferably, the supplying section recirculates any excess amount of the vaporizable dye.

The supplying section may recirculate any excess amount of the vaporizable dye with the aid of beads.

Preferably, the supplying section adds heat responsive to the laser light to the vaporizable dye as the heat of vaporization.

Preferably, the laser light employed for generating the heat of vaporization in the vaporizing section is a laser light having equalized radiation intensity distribution.

According to the present invention, there is also provided a photographic paper in which a vaporized vaporizable dye is absorbed on a receptor layer provided in the form of an upper layer of the photographic paper base, and wherein a light absorbing layer formed by a light absorbing agent is provided between the photographic paper base and the receptor layer.

Preferably, the light absorbing layer is whitened in color by thermal destruction of the light absorbing agent itself by a light radiating body in the printing device.

Preferably, the light absorbing layer is whitened in color by thermal destruction of a capsule containing a whitening agent by a light radiating body in the printing device and thus enable the content of the capsule to be mixed into the light absorbing layer.

As the light absorbing agent, an infrared ray absorber capable of absorbing infrared rays may be employed. Some of the infrared ray absorbers may also exhibit color extinguishing characteristics.

Typical of the light absorbing agent is a functional near-IR absorption coloring matter manufactured by SHOWA DENKO KK under the trade name of IR 820B which exhibits maximum absorption for light having a wavelength of 825 nm. If it is present with an ammonium salt of organic boron, such as tetrabutyl ammoniumbutyl triphenyl borate, in a solution, it absorbs the near IR rays in a manner wherein its color is extinguished.

Examples of the whitening agents include titanium oxide, zinc oxide and calcium oxide.

The capsules employed for enclosure of the whitening agents may be formed of condensates, such as polyurea or polyurethane, homopolymers such as polyethylene or polyvinyl alcohol or waxes such as paraffins or lipids.

According to the present invention, there is also provided a printing device in which a vaporizable dye is thermally transcribed onto a receptor layer provided as an upper layer of the photographic paper base, and wherein a light radiating body for whitening the color of a light absorbing agent of a light absorbing layer provided between the photographic paper base and the receptor layer, is provided.

Preferably, the light emitting body radiates light in the form of a laser.

It will be noted that the term "vaporizable dye" as used in connection with the present invention is taken to collectively include a solidified disperse dye, a liquefied disperse dye, a vaporized disperse dye, a sublimable dye and a disperse dye. Thus, the vaporizable dye is defined as a dye having a temperature domain, in a temperature range of from 25° C. up to a decomposition temperature, for which temperature domain the vapor pressure is not less than 0.01 Pascal, on the proviso that, if the dye molecules are associated in a gaseous phase at an average association number of n, the vapor pressure divided by the average number of association n, is not less than 0.01 Pascal.

Although a sublimable dye changed from its solid state to a gaseous state may be contemplated as the vaporizable dye, a dye having a liquid state between its solid and gaseous states is also included within the meaning of the vaporizable dye.

Among a variety of the vaporizable dyes, a yellow dye, having a color index number "C. I. Disperse yellow 201", manufactured by SUMITOMO KAGAKU KK under the trade name of "ESC-Yellow 155" and a cyan dye having a color index number "C. I. Solvent Blue 63", manufactured by SUMITOMO KAGAKU KK under the trade name of "ESC- Blue 655" can be employed in the printing device of the present invention. As a magenta dye, a tricyanomethine dye manufactured by MITSUBISHI KASEI KK under the trade name of "HSR-2031" can be employed.

With the printing device according to the present invention, a dye tank stows the particulate vaporizable dye, and an entrance section liquefies the vaporizable dye and transports the thus liquefied dye to a vaporizing section, wherein the liquefied dye is vaporized using the heat supplied by a laser light and transcribed onto the photographic paper. The heat generating effect of the vaporizing section is improved by the laser and enables the size of the heat radiating mechanism to be reduced. Printing becomes possible without employing an ink ribbon or a thermal head, as a result of which power saving and reduction in size and costs may be achieved. By preliminary heating within a low heat conducting material and employing the heat corresponding to the intensity of the laser light for vaporization, the heat efficiency may be improved. The degree of freedom in photographic paper size may be increased because no ink ribbon is necessitated. By providing a light absorbing layer in the photographic paper, the operating efficiency is improved, and the printing time may be shortened.

It is also possible to conduct the liquefied vaporizable Y-dye to the vaporizing section by taking advantage of the capillary phenomenon produced with the aid of beads, or to use beads in the vaporizing section.

Since the receptor layer of the photographic paper may be heated by the laser light, the portions of the photographic paper other than the receptor layer are not affected by heat.

If the laser light has a flat light intensity distribution, the photo-thermal conversion efficiency may be improved.

With the sublimation type printing device according to the present invention, the containing section stows the particulate vaporizable dye, and the entrance section liquefies the particulate vaporizable dye and transports the thus liquefied dye to a vaporizing section. The liquefied dye is vaporized and transported by the entrance section using the heat of vaporization generated by the laser light and thereafter transcribed onto the photographic paper. In this manner, printing becomes possible without employing an ink ribbon or a thermal head so that the printing device may be reduced in size and weight. Dye exchange may be facilitated because the containing section stowing the dye may be removed and exchanged for a new one. Since the heat of vaporization corresponds to the laser light, excess heat or heat radiation is not required to enable the energy saving. Since the dye may be supplied singly, the photographic paper needs to be fed only once so that the printing time may be shortened. Freesize printing becomes possible because there is no limitation as to the photographic paper size imposed by the ink ribbon.

Besides, since the light absorbing layer formed of a light absorbing agent capable of generating heat by efficiently absorbing the light is provided between the receptor layer and the photographic paper base, the receptor layer may be heated directly to assure a high quality printed picture.

In addition, since a light radiating body interposed between the receptor layer and the photographic paper base of the photographic paper whitens the color of the light absorbing agent of the light absorbing layer a high quality printed picture is assured.

Consequently, if printing is made on the above-mentioned photographic paper by the above-mentioned printing device, the printing efficiency may be improved and the thrusting force between the dye source and the receptor layer may be reduced, enabling resistance to abrasion to be improved. The picture quality is also improved because the light absorbing agent may be whitened in color.

If the laser light radiated by a laser block has an equalized light intensity distribution, it becomes possible to equalize the heat conversion occurring at the light absorbing layer of the photographic paper.

The above and other objects and advantages of the present invention will become apparent from the following description of the preferred embodiments and the claims.

DETAILED DESCRIPTION OF THE PREFERRED EMBODIMENTS

Figure 1:
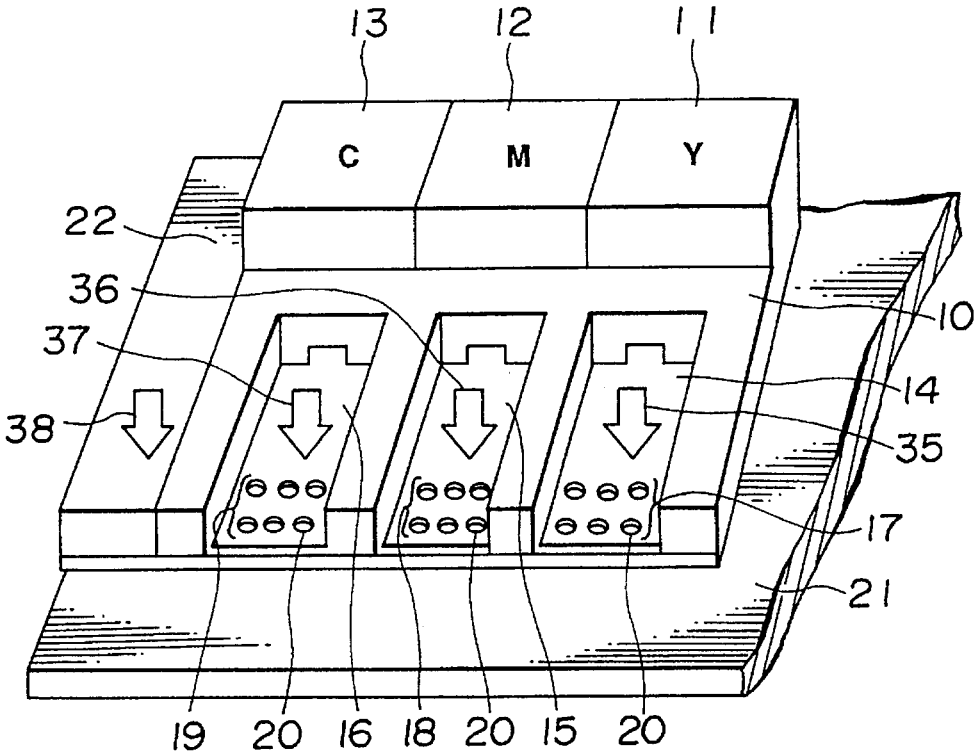
FIG. 1 is a perspective view showing essential portions of a first embodiment.

Referring to the drawings, preferred embodiments of the printing device and the photographic paper according to the present invention will be explained in detail.

In the first embodiment of the present invention, a vaporizable dye is employed as a dye.

The term vaporizable dye collectively refers to solidified disperse dyes, liquefied disperse dyes, vaporized disperse dyes, sublimable dyes and disperse dyes, in which a temperature range with a vapor pressure of not lower than 0.01 pascal exists in a temperature range from 25° C. to the dye decomposition temperature. If the dye molecules are associated in the gaseous phase with one another with a mean number of association of n, the vapor pressure divided by the mean number of association is to be not less than 0.01 Pascal.

In the present first embodiment, among the above-mentioned vaporized dyes, a vaporized dye manufactured by SUMITOMO KAGAKU KK under a trade name of "ESC-Yellow 155" having a color index number of "C. I. Disperse Yellow 201" is employed as a yellow dye, and is referred to hereinafter as Y.

As a C dye, a dye manufactured by SUMITOMO KAGAKU KK under the trade name of "ESC-Blue 655", having a color index number of "C. I. Solvent Blue 63" is employed.

As an M dye, a tricyanomethine dye of the following chemical formula

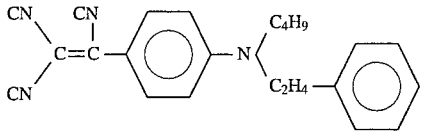

[formula 1]

manufactured by MITSUBISHI KASEI KK under the trade name of "HSR-2031" is employed.

With the first embodiment, the above-mentioned vaporizable dyes Y, C and M are ultimately vaporized and thermally transcribed onto the photographic paper. Therefore, a printer according to the first embodiment is referred to hereinafter as a sublimation type printer.

The sublimation type printer of the first embodiment, main portions of which are shown schematically in FIG. 1, includes a main body 10, which is formed of special high melting plastics, such as polyimide, which has low heat conductivity and which is devoid of heat moldability, dye tanks 11, 12 and 13 containing the above-mentioned vaporizable Y, M and C dyes in a powdery state; entrance sections 14, 15 and 16 for heating the powdery dyes Y, M and C contained in the dye tanks 11 to 13 to their melting points and for transporting the liquefied dyes; and vaporizing sections 17, 18 and 19 for vaporizing the vaporizable dyes, which have ben liquefied by these entrance sections 14 to 16, using the heat supplied by a laser light beam. The vaporized dyes are deposited on a photographic paper 21 via vaporization openings, not shown, formed in the bottom parts of recesses or sinks 20 for dyes provided in each of the vaporizing sections 17 to 19. These vaporizing sections 17 to 19 are irradiated with laser beams from leaser emitting sections for dyes Y, M and C, not shown, as shown by arrows 35, 36 and 37, respectively. A transparent section 22, formed of a glass material with high transmittance to permit a laser light to be transmitted therethrough without losses, is also irradiated with another laser light beam, as shown by an arrow 38, from a laser radiating section, not shown.

Figure 2:
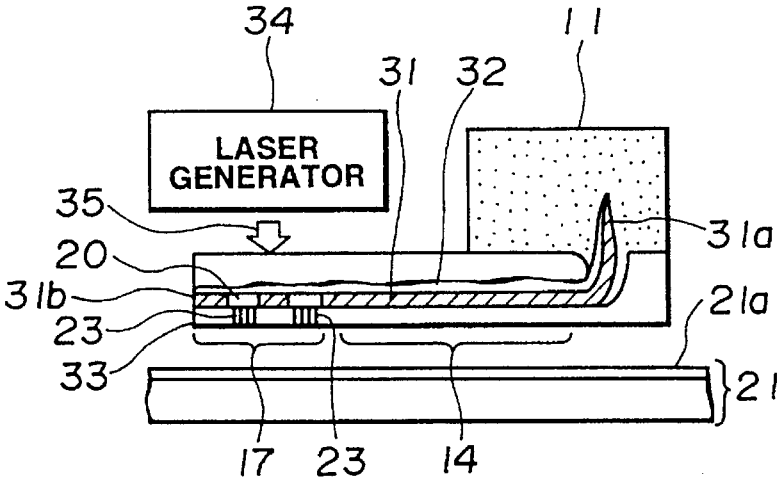
FIG. 2 is a cross-sectional view showing essential portions of the first embodiment.

FIG. 2 shows details of the construction of a sublimation type printer according to the present first embodiment.

In FIG. 2, which is a sectional view showing essential portions shown in FIG. 1, a laser radiating portion 34 and vaporization openings 23, not shown in FIG. 1, are illustrated. Meanwhile, since the dye tanks 11 to 13, entrance sections 14 to 16 and the vaporizing sections 17 to 19 are each of an identical construction, only the dye tank 11 for dye Y, entrance section 14 and the vaporizing section 17 will be explained herein for brevity.

The entrance section 14 and the vaporizing section 17 are associated with a first heating member 31 designed to impart heat indirectly to the photographic paper 21. The first heating member 31 has its one end 31*a* bent substantially vertically upwards so as to project into the dye tank 11. The first heating member 31 has its other end 31*b* extended up to a terminal end of the vaporizing section 17.

The vaporizable dye Y, liquefied by being heated by the end 31*a* of the first heating member 31, referred to hereinafter as the liquefied vaporizable dye 32, is transported by the entrance section 14 up to the entrance section 14. The entrance section 14 is associated with the first heating member 31, as mentioned above. This first heating member 31 is formed of carbon or silicon compounds for example, and is capable of radiating heat of 50° C. to 300° C. on current conduction therethrough to liquefy the vaporizable dye and to maintain the latter in the liquefied and heated state. The first heating member 31 is of a capillary construction having superficial grooves and is adapted to transport the liquefied vaporizable dye 32 up to the vaporizing section 17.

That is, the first heating member 31 transports the vaporizable dye 32, liquefied under the heat e.g. of 50° C. to 300° C., as far as the vaporizing section 17, while keeping the dye warm enough not to solidify or thicken.

The vaporizing section 17 includes a first heating member similar to that provided in the entrance section 14. The first heating member 31 of the vaporizing section 17 has a plurality of dye sink recesses 20 for storing the liquefied vaporizable dye. The bottom of each dye sink recess 20 has a large number of vaporizing openings 23 in the form of fine through-holes each having a diameter of several microns.

The vaporizing section 17 is provided with a second heating member, not shown, in addition to the first heating member 31. The second heating member is formed as layer of a semi-transparent light absorbing agent coated on the surface of the first heating member 31 and each of the dye sink recesses 20. The second heating member is occasionally referred to herein as a light absorbing layer.

The light absorbing layer efficiently translates the laser light indicated by arrow 35 emitted by the laser emitting section 34, into heat. That is, the liquefied vaporizable dye 32, transported by the entrance section 14 as far as the vaporizing section 17, is heated up to its vaporizing temperature by the light absorbing layer which efficiently translates the laser light indicated by arrow 35 from laser radiating section 34, into heat. The vaporized dye is transferred onto the receptor layer 21*a* of the photographic paper 21 via the vaporizing openings 23 formed in the bottom of the dye sink recesses 20.

Figure 3:
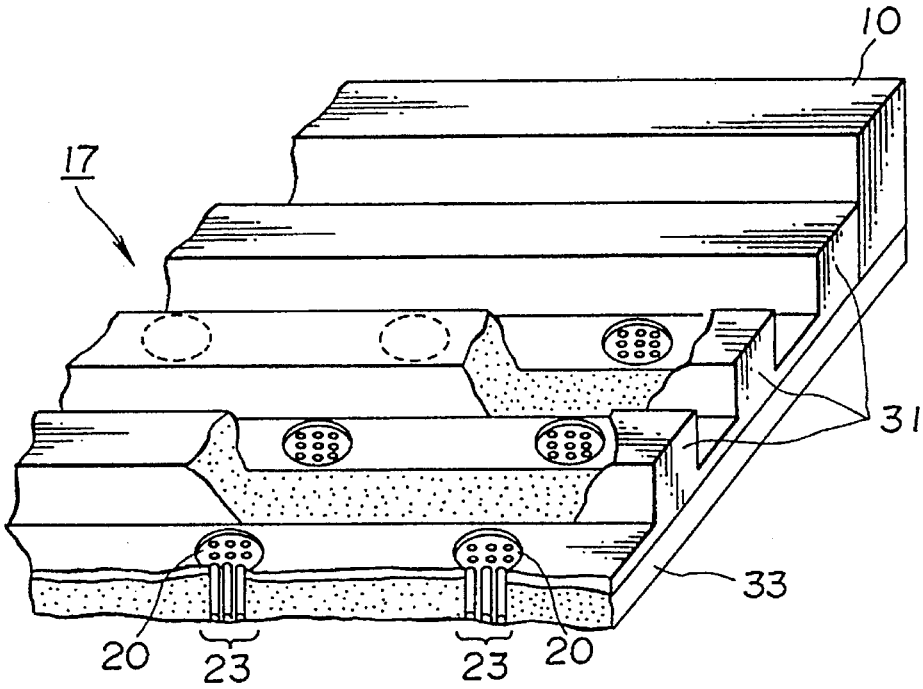
FIG. 3 is a perspective view showing essential portions of a vaporizable portion of the first embodiment.

The construction of the vaporizing section 17 is shown in FIG. 3.

In this figure, the semi-transparent light absorbing agent, as the above-mentioned second heating member, is coated on the first heating member 31 and on the surface of the bottom of the dye sink recesses 20.

The liquefied vaporizable dye 32, shown in FIG. 2, transported as far as the vaporizing section 17 by the first heating member 31 having a trenched or grooved structure, is stored in the dye sink recesses 20. At this time, the laser light is radiated from the laser radiating section 34 shown in FIG. 2 onto the dye sink recesses 20 so that the laser light is efficiently translated into heat by the light absorbing layer of the light absorbing agent, and vaporizes the liquefied vaporizable dye 32. The vaporized dye is absorbed by diffusion into the fine vaporizing openings 23 each of a diameter not larger than several microns, formed in the bottom of the dye sink recesses 20. The vaporizing openings 23 are formed so as to pass through a protective layer 33 so that the vaporized dye is transcribed by diffusion onto the receptor layer 21*a* of the photographic paper 21 shown in FIG. 2.

Part of the laser light is transmitted through the semi-transparent light-absorbing layer as far as the photographic paper 21. Part of the light which has reached the photographic paper 21 is used to heat the receptor layer 21*a* and to aid in deposition of the vaporizable dye vaporized by the vaporizing section 17.

The operation of the sublimation type printer according to the above-described first embodiment is hereinafter summarized with reference to FIGS. 1 to 3.

With the sublimation type printer of the first embodiment, the vaporizable dye contained within the dye tank 11 is liquefied by being heated by the first heating member 31 up to its melting point. The liquefied vaporizable dye 32 is transported to the vaporizing section 17 by the capillary phenomenon of the entrance section 14. The entrance section 14 heats the liquefied vaporizable dye 32 using the first heating member 31 to maintain its temperature. In addition to the first heating member 31, which is the same as that provided in the entrance section 14, a semi-transparent light absorbing layer which acts as the second heating member is provided in the vaporizing section 17 for converting laser light into heat. The vaporized dye is transferred onto the receptor layer 21*a* of the photographic paper 21 by a difussion phenomenon brought about by the vaporizing openings 23 in the bottom of each of the dye sink recesses 20 provided in the vaporizing section 17.

Figure 4:
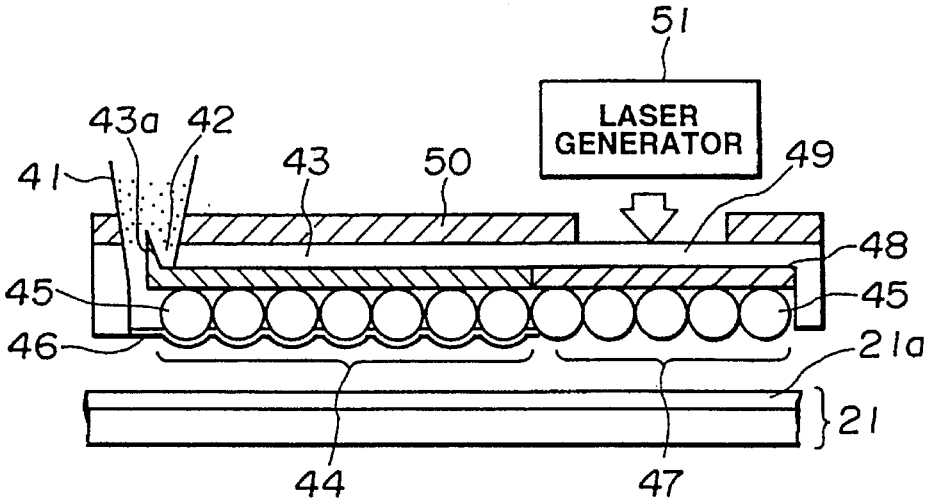
FIG. 4 is a cross-sectional view showing essential portions of a first embodiment employing beads in the vaporizable portion.

The vaporizing section 17 of the sublimation type printer according to the first embodiment may also be designed for transcribing the vaporized dye onto the receptor layer 21*a* of the photographic paper 21 by the diffusion phenomenon brought about by beads 45 such as those shown in FIG. 4.

In FIG. 4, an essential portion of the dye tank for the dye Y, is shown in cross-section.

In this figure, the first heating member 43 has one end 43*a* introduced into a dye supply opening 42 formed in the lower end of the dye tank 41. This end 43*a* of the first heating member 43 melts and liquefies the vaporizable dye. The liquefied vaporizable dye is supplied to the entrance section 44. In the entrance section 44, a number of beads 45 are arrayed along the first heating member 43. Each bead 45 has its upper part bonded to the first heating member 43 and its lower end covered with a protective layer 46. Similarly, a number of beads 45 are bonded to the first heating member 43 and to a second heating member 48. The lower part of the beads 45 of the vaporizing section 47 are not covered. The first heating member 43 and the second heating member 48 are both bonded to a base 49.

The base 49 is transparent or otherwise formed with a through-hole in a light transmitting portion thereof for transmitting the light. The base 49 needs to be of as thin a structure as possible. To this end, a reinforcement 50 is provided on the top of the base 49.

The adhesive employed for bonding the beads 45, first heating member 43 and the second heating member 48 is both heat resistant and transparent.

The protective layer 46 is employed for preventing intrusion of impurities or dust and dirt, so that it is formed of a material which is resistant to heat and abrasion and which is low in heat conductivity. The beads 45 are also heat-resistant and are formed of glass or a heat-resistant synthetic material.

The vaporizing section 47 deposits the vaporized dye onto the photographic paper 21 using the capillary phenomenon produced by the beads 45. The beads 45 are arrayed along the first heating member 43 and the second heating member 45 in a manner shown in FIG. 5 (a back side view showing the vaporizing section 47 and the entrance section 44).

The second heating member 48, employed in the vaporizing section 47 along with the first heating member 43, is formed of a light absorbing material.

Figure 5:
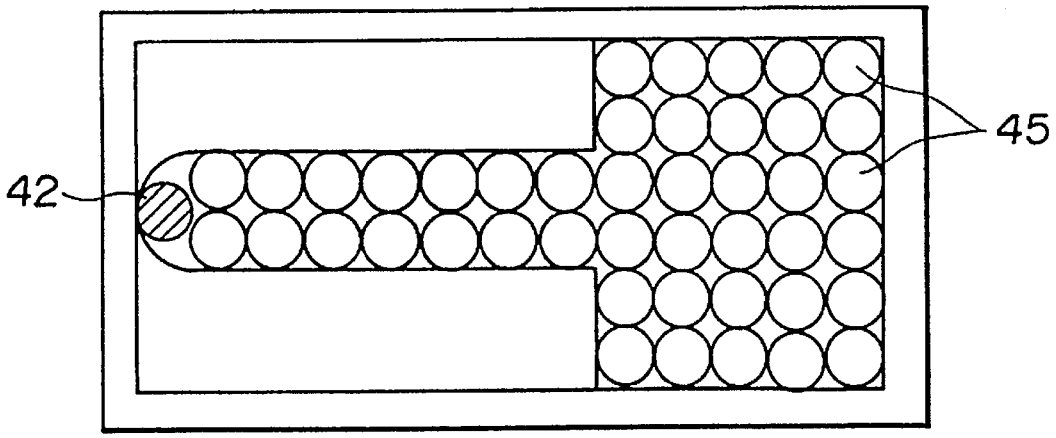
FIG. 5 is a back side view showing essential portions of the first embodiment.
Figure 6:
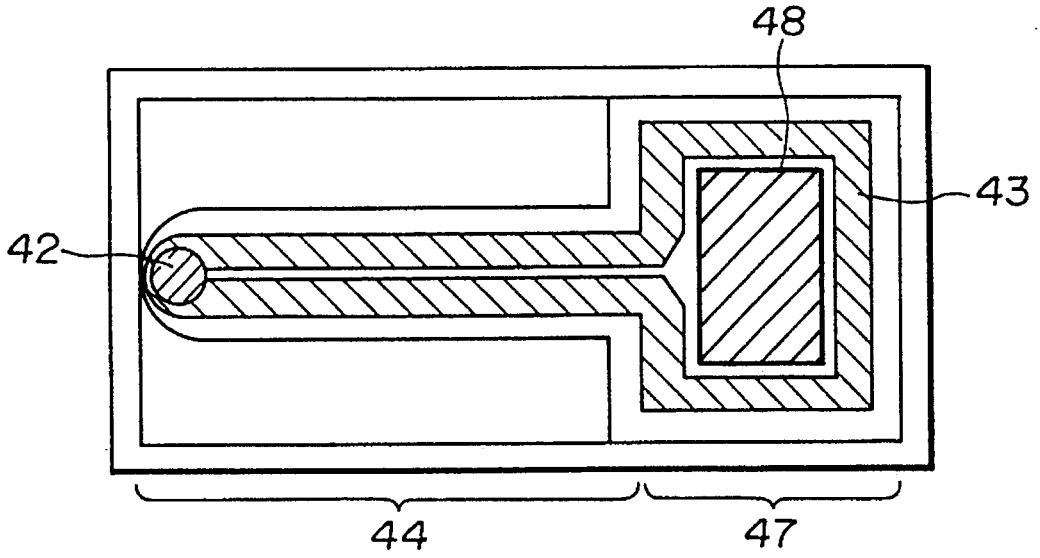
FIG. 6 is an illustrative view showing essential portions of the first embodiment.

In the vaporizing section 47, the second heating member 48 is surrounded in its entirety by the first heating member 43, as shown in FIG. 6, which is a view similar to FIG. 5 except that the beads 45 are not shown.

The operation of the vaporizing section 47, employing the beads 45, is hereinafter explained by referring to FIGS. 4 to 6.

The vaporizable dye contained in the dye tank 41 is heated to e.g. 50° C. to 300° C. by the first heating member 43 so as to be turned into a liquefied vaporizable dye which is then permeated through voids defined between beads 45 and kept at the above temperature by the first heating member 43. The liquefied vaporizable dye is then guided under the capillary phenomenon brought about by beads 45 to reach the vaporizing section 47.

The liquefied vaporizable dye which has reached the vaporizing section 47 is vaporized by being heated by the second heating member 48 which is adapted to efficiently generate heat using the laser light from a laser generating section 51. The dye thus vaporized is passed through voids defined by adjacent beads 45 by diffusion so as to be transcribed onto the receptor layer 21*a* of the photographic paper 21 via the lower ends of the beads 45 not covered by the protective layer 46.

As a modification of the above-described embodiment in which the beads 45 are employed in the vaporizing section 47, carbon compounds or light absorbing materials may be contained in or otherwise coated on the surface of the beads so that the beads 45 may simultaneously be employed as the light absorbing material of the second heating member 48.

due to the use of the beads 45 in the vaporizing section 47, the vaporizing openings are of uniform size to assure a constant amount of vaporization of the vaporizable dye. The light absorbing agent may be coated on or contained in the beads 45 for simplifying the construction. The capillary phenomenon may be easily brought about with a material that cannot be etched. Gradation control may be facilitated by the constant amount of vaporization. Besides, the bead size may be suitably chosen for controlling the air quantity and adjusting the amount of the heat storage. The heat efficiency may be improved by combining the reinforcement with base 49. Intrusion of dust and dirt or impurities may be inhibited by coating an area other than the vaporizing openings with the protective layer 46. The beads may be used simultaneously as the wear-resistant layer in contact with the photographic paper 21 to simplify the construction.

Figure 7:
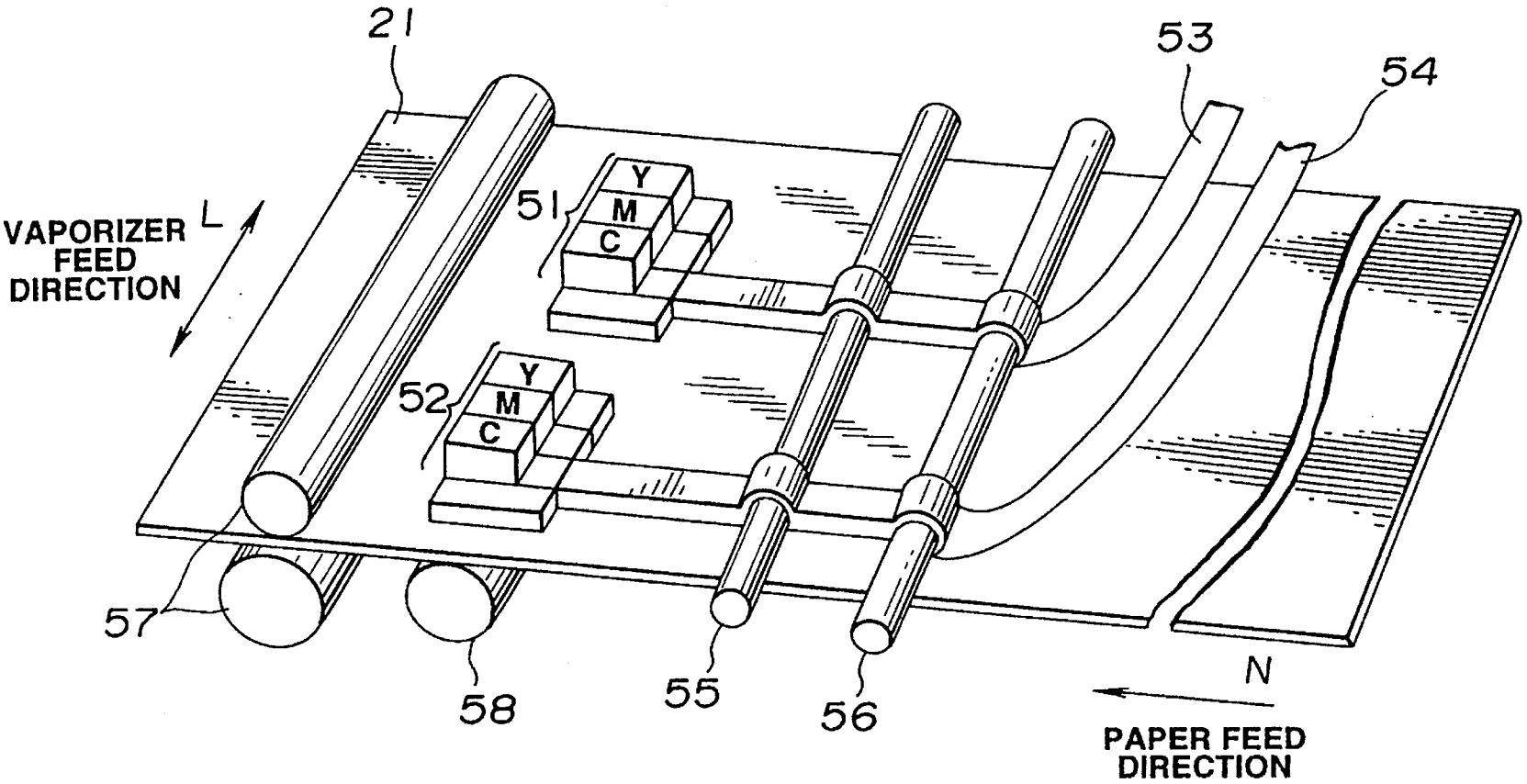
FIG. 7 is a perspective view showing a typical printing mechanism for the first embodiment.

An illustrative example of a printing mechanism employing the sublimation type printing device according to the above-described first embodiment is explained by referring to FIG. 7.

The printing mechanism includes vaporizing units 51, 52 each consisting in a laser emitting unit built into a sublimation type printer of the first embodiment the essential part of which is shown in FIG. 1. The two vaporizing units 51, 52 are of identical construction comprising dye layers 11, 12 and 13, entrance sections 14, 15 and 16, vaporizing sections 17, 18 and 19, four laser radiating sections and a transparent section 22.

These vaporizing units 51, 52 are connected to signal lines 53, 54 and are moved by a vaporizing unit feed shaft 55 and a vaporizing unit supporting shaft 56 in the vaporizing unit feed direction indicated by arrow L.

The photographic paper 21 is fed by a photographic paper driving roll 57 in the paper feed direction indicated by arrow N. The vaporizing units 51, 52 and the photographic paper 21 are pressed into tight contact with each other by a vaporizing unit supporting roll 58.

The photographic paper 21 is introduced into a space between the vaporizing units 51, 52 and the vaporizing unit supporting roll 58. With the printing mechanism shown in FIG. 7, the two vaporizing units 51, 52 are provided for printing in two sections, with the vaporizing unit being fed in one line. The vaporizable dyes Y, M and C are simultaneously heated and melted by the heating members within the vaporizing units 51, 52 so as to be turned into liquefied vaporizable dyes.

The vaporizable dye liquefied in the vaporizing units 51, 52 is heated by the laser light beams associated with picture signals from the Y, M and C laser radiating units so as to be turned into the vaporized dye which is transcribed onto the receptor layer 21*a* of the photographic paper 21.

After completion of one-line printing, the photographic paper 21 is fed by one-line length by a photographic paper driving roll 57. Printing is started sequentially for each color and performed in a similar manner after the third dot.

A second embodiment concerning a printing device according to the present invention is hereinafter explained by referring to FIG. 8.

Each dye employed in the present second embodiment is similar to the sublimable dye employed in the sublimation type printer according to the first embodiment. Since the vaporizable dyes Y, C and M of the present second embodiment are also ultimately vaporized and thermally transcribed onto the photographic paper, the present device is referred to herein as a sublimation type printer.

Figure 8:
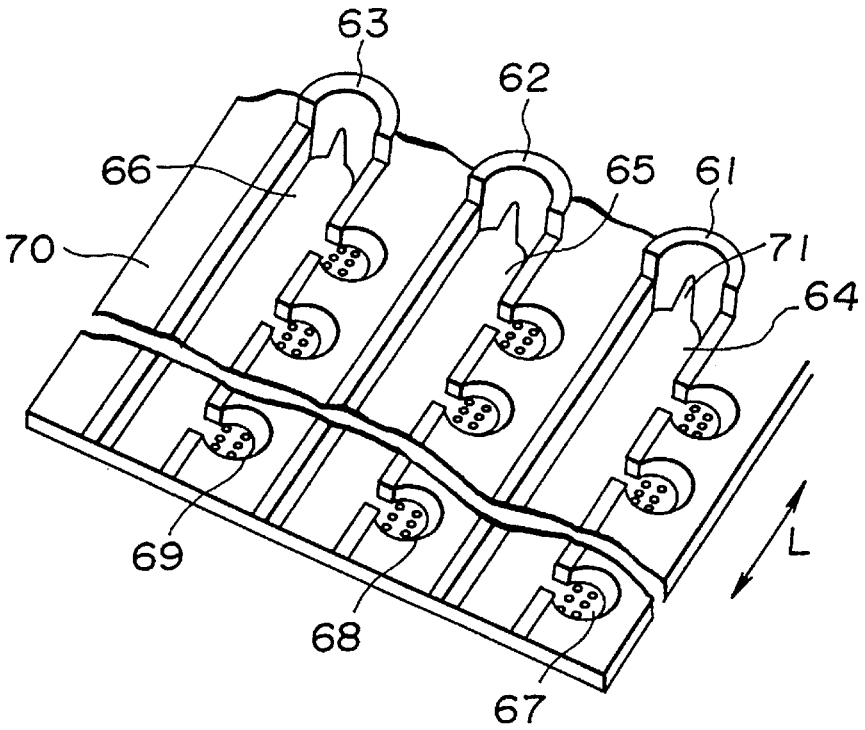
FIG. 8 is a perspective view showing essential portions of a second embodiment.

The sublimation type printer according to the second embodiment, essential parts of which are shown schematically in FIG. 8, includes dye tanks 61, 62 and 63 containing powdered vaporizable dyes Y, M and C, entrance sections 64, 65 and 66 for liquefying the vaporizable dyes supplied from the vaporizing sections 61 to 63 and transporting the liquefied dyes and vaporizing sections 67, 68 and 69 for vaporizing the vaporizable dyes liquefied by these entrance sections 64 to 66 by the vaporizing heat supplied by the laser light from laser light emitting means, not shown. The vaporizable dye is transcribed onto the photographic paper 21 via the vaporizing openings formed in the vaporizing sections 67 to 69. It is noted that a plurality of each of the vaporizing sections 67 to 69 are provided along each of the entrance sections 64 to 66. For example, a number of the vaporizing sections 67 corresponding to the number of dots of a picture are provided along the line direction of the photographic paper shown by arrow L in FIG. 8. The same is true of the vaporizing sections 68 and 69.

The operation of the sublimation type printer according to the second embodiment is explained in connection with the dye tank 61, entrance section 64 and the vaporizing sections 67 shown in FIG. 8.

A first heating member 71 at the entrance section 64 heats the vaporizable dye in the dye tank 61 so that the vaporizable dye is turned into a liquefied vaporizable dye. The entrance section 64 transports the liquefied vaporizable dye up to the vaporizing sections 67 under a capillary phenomenon as in the case of the sublimation type printer of the previously explained first embodiment.

The liquefied vaporizable dye from the dye tank 61 is transported by the entrance section 64 onto the plural vaporizing sections 67 which are sequentially irradiated with the laser light radiated by laser radiating means, not shown. That is, the first heating member 71 of the entrance section 64 liquefies the vaporizable dye contained in the dye tank 61 at its one end and transports the liquefied vaporizable dye as far as the vaporizing sections 67 by its capillary structure provided by the beads or flutes as it maintains the temperature of 50° C. to 300° C. of the dye to prevent its solidification.

The vaporizing sections 67 are also provided with the first heating member 71 similar to that provided for the entrance section 64. Each vaporizing section 67 is provided with a plurality of fine vaporizing openings each having a diameter of several microns. Besides the first heating member 71, a second heating member 72 is also provided for the vaporizing sections 67. The second heating member comprises a light absorbing layer formed by coating a semi-transparent light absorbing agent on the first heating member 71 and the vaporizing openings. The second heating member efficiently translates the laser light from a laser radiating section, not shown, into heat, so that the vaporizable dye introduced into the vaporizing sections 67 is vaporized so as to be transcribed onto the receptor layer of the photographic paper via the vaporizing openings formed in the vaporizing sections 67. The same construction is employed for the dye tanks 62, 63, entrance sections 65, 66 and the vaporizing sections 68, 69.

Besides, since the light absorbing layer is semitransparent, part of the light which has reached the photographic paper 21 is used for heating its receptor layer 21*a* and to aid in deposition of the vaporizable dye vaporized by the vaporizing sections 67.

An illustrative example of a printing mechanism employing the sublimation type printer according to the second embodiment is hereinafter explained with reference to FIG. 9.

This printing mechanism comprises a sublimation type printer of the second embodiment, the essential portions of which are shown schematically in FIG. 8, and a pair of movable laser blocks 82, 83 of identical construction for radiating the laser light on the laser block 81 for printing. The sublimation type printer is secured in position as a head block.

Figure 10:
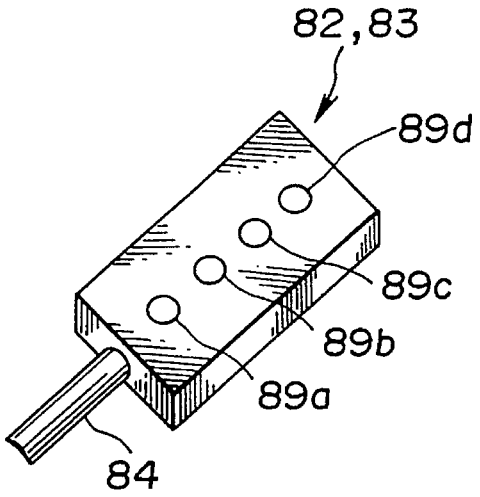
FIG. 10 is a back side view showing a laser block provided for the printing mechanism shown in FIG. 9.

Each of the laser blocks 82, 83, the reverse side of which is shown in FIG. 10, has a laser light outgoing opening 89*a* for Y printing, a laser light outgoing opening 89*b* for M printing, a laser light outgoing opening 89*c* for C printing and a laser light outgoing opening 89*d* for the photographic paper. These laser blocks 82, 83 are connected to a signal line 84 for laser light and is moved by a laser block feed shaft 85 and a laser block supporting shaft 86 in the line direction as indicated by arrow L. At this time, the laser light outgoing opening 89*a* for Y printing, the laser light outgoing opening 89*b* for M printing and the laser light outgoing opening 89*c* for C printing are positioned directly above the vaporizing sections 67, 68 and 69 of the head block 81, respectively.

The photographic paper 21 is fed by paper driving rolls 87 in the paper feed direction indicated by arrow N. The photographic paper 21 is pressed by the paper supporting roll 88 into intimate contact with the head block 81.

The photographic paper 21 is inserted into a space between the head block 81 and the supporting roll 88. The vaporizing sections 67, 68 and 69 are arrayed in alignment with the printing direction indicated by arrow N, with the number of each of the vaporizing sections 67 to 69 along the line direction indicated by arrow L being the same as the number of pixels. The laser light radiating openings in the laser blocks 82, 83 are set so as to be in register with the vaporizing sections 67, 68 and 69 of the head block 81 in the paper feed direction or printing direction and arrayed at a rate of the number of the openings to the number of the vaporizing sections 67 to 69 of the head block 81 in the line direction of 1:1 or 1:1/n. If the laser light radiating openings are arranged at a number rate of 1:1 with respect to the vaporizing sections in the head block 81, the laser radiating openings may be provided in the laser block 81. Even if the laser light radiating openings are arranged at a number rate of 1:n with respect to vaporizing sections in the head block 81, the laser radiating openings may be provided in the laser block 81 at a number rate of 1/n.

The vaporizable dyes Y, M and C are heated simultaneously by the first heating member within the head block 81 so as to be turned into the liquefied vaporizable dye.

The vaporizable dyes, liquefied by the vaporizing sections 67, 68 and 69 within the head block 81, are additively heated by the laser light beams corresponding to the picture signals from the laser blocks 82, 83 so as to be transcribed onto the receptor layer 21*a* of the photographic paper 21 via the vaporizing openings which provide for dye diffusion. If the laser radiating openings are provided at the number rate of 1/n with respect to the vaporizing sections, the laser blocks 82, 83 are moved in the line direction indicated by arrow N for completing the printing for one line. The same operation is performed for each of the dyes M and C. The printing for three lines at the start and end of printing is made sequentially and that for the remaining lines is performed simultaneously for the Y, M and C dyes. On completion of printing for one line, the photographic paper 21 is fed by one line by the photographic paper driving roll 87.

Thus, with the present sublimation type printer according to the present second embodiment, the head block 81, provided with a plurality of each of the vaporizing sections 67 to 69, is fixed, while the laser blocks 82, 83, having the laser radiating openings thereof aligned with the vaporizing sections 67 to 69, are moved and the vaporizable dyes, liquefied by the laser light beams corresponding to the picture signals, are additively heated and vaporized for transcription on the photographic paper.

Meanwhile, each vaporizing section of the sublimation type printer according to the second embodiment may also be arranged in accordance with the principle of the capillary phenomenon brought about by beads.

It should be noted that, if a laser light is radiated on the vaporizing sections of the sublimation type printer according to the first or second embodiment after being equalized in intensity in the laser generating section and in the laser blocks over its range of distribution, heat transformation in the light absorbing layer may be equalized and, besides, the energy transformation efficiency may be maximized.

If a semiconductor laser having a light distribution in which the energy density becomes higher towards its mid portion is radiated onto a light absorbing layer is provided in close proximity thereto, a non-uniform thermal energy having only poor efficiency as the energy used for transcribing the dye, is produced. Besides, since the energy density is high at the mid region, the receptor layer of the photographic paper onto which the dye is transferred tends to be dissolved or even scorched under the high heat. Also, in view of the angle of light diffusion, the distance between the light source and the an object receiving the light tends to be limited. In addition, because of the non-uniform light distribution, the density of transcription tends to be thicker and thinner towards the mid region and towards the edge portion of the photographic paper, respectively.

It may be contemplated to expand the light distribution of the laser light from the laser light source by a diffusion plate or a concave lens for providing a uniform light distribution on the irradiated surface. That is, it suffices to diminish the degree of concentration towards the mid region in the above-described energy distribution to relax the light concentration to provide a flat light distribution.

Figure 11:
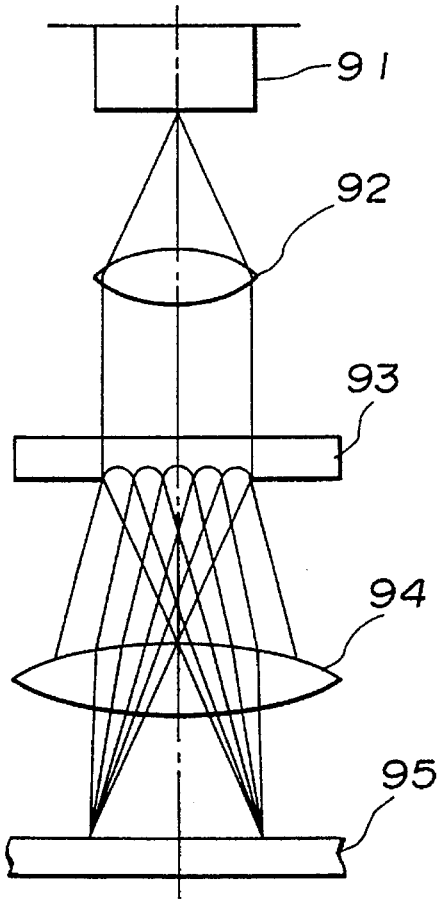
FIG. 11 shows an arrangement of an optical system for equalizing the distribution of the laser light intensity.

FIG. 11 shows an optical system for generating a laser light having an equalized range of distribution of laser light intensity.

Figure 12A:
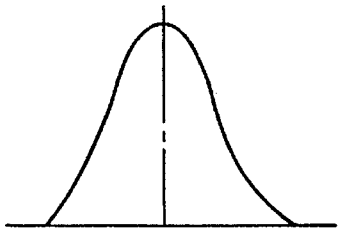
FIG. 12A is a graph showing the distribution of the laser light intensity in case of not employing the optical system shown in FIG. 11.
Figure 12B:
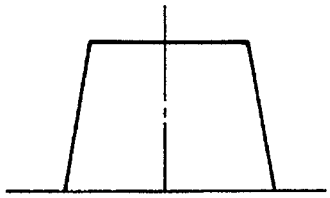
FIG. 12B is a graph showing the distribution of the laser light intensity in case of employing the optical system shown in FIG. 11.

Referring to FIG. 11, a laser light radiated from a semiconductor laser 91 is collimated by a collimator lens 92 which is converted into diffused light by e.g. a flat plate micro-lens 93 of a fine micro-lens array construction. The diffused light is then caused to fall on a convex lens 94 which condenses the diffused light to radiate a light having a uniform light intensity distribution onto a light absorbing layer. In this manner, the light distribution similar to a Gaussian distribution, as shown in FIG. 12A, is converted into a trapezoidal light distribution as shown in FIG. 12B.

Therefore, if the distribution of irradiation of the laser light, employed for generating the heat of vaporization at a vaporizing section, is equalized using the optical system shown in FIG. 11, the light energy may be converted into a heat energy with a high efficiency. Besides, the use of the above-described optical system leads to a uniform transcription density and coloration with high resolution. The distance between the light source and the irradiated member may be set freely. Besides, a suitable size of coloration may be achieved depending on the manner of designing of the optical system and the semiconductor laser power.

A third embodiment of the present invention concerning the printing device is hereinafter explained with reference to FIG. 13.

In the present third embodiment, a particulate vaporizable dye, consisting in a mixture of the vaporizable dyes Y, M and C as used in the sublimation type printer of the first or second embodiment and a dispersant compatible with the vaporizable dyes, such as a volatile binder, is employed and vaporized so as to be transcribed under heat onto the photographic paper. For this reason, the third embodiment is referred to herein as a sublimation type printer.

Figure 13:
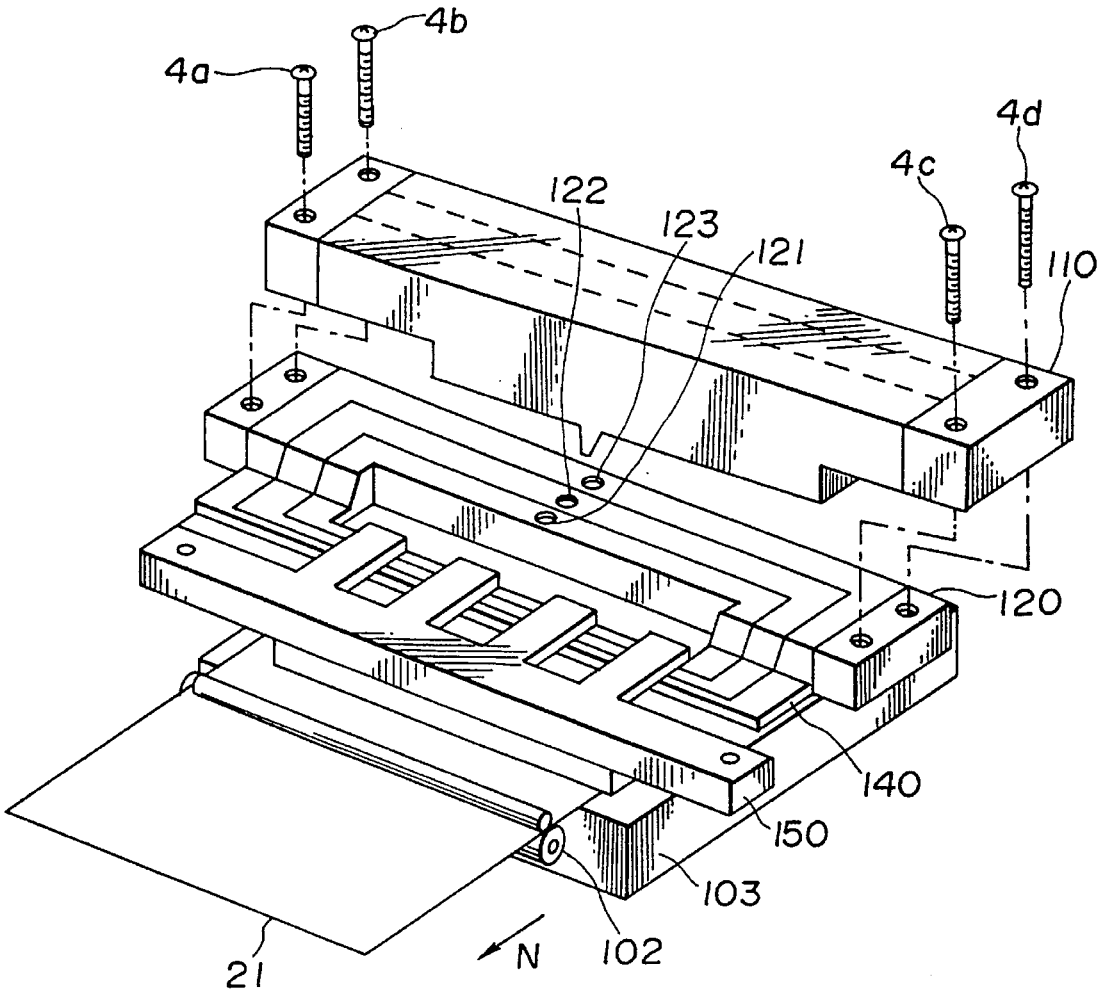
FIG. 13 is a perspective view showing essential parts of a third embodiment.

The sublimation type printer according to the third embodiment, shown schematically in FIG. 13, comprises a dye pack 110 having separate tanks for the particulate Y, M and C dyes, a dye supply pre-stage section 120 for shifting the particulate vaporizable dyes from the dye pack 110 in one predetermined direction, a dye supply post-stage section 140 for receiving the particulate vaporizable dye from the pre-stage section 120, a vaporizing section, not shown, for receiving and vaporizing the particulate vaporizable dye supplied from the pst-stage section 140, a laser block 150 for radiating a laser light onto the vaporizing section for generating the heat of vaporization therein, a paper feed roll 102 for feeding a photographic paper 21 in a direction shown by arrow N so that the vaporized dye is transcribed thereon, and a photographic paper tray 103 for storing a roll of the photographic paper 21.

Figure 14:
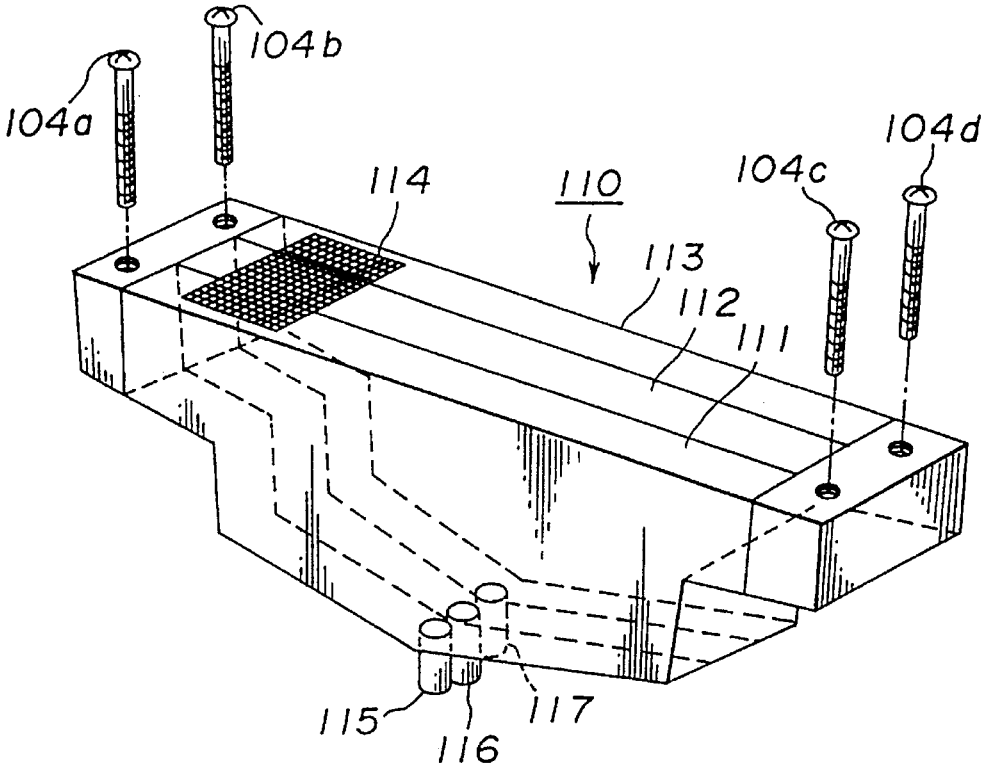
FIG. 14 is a perspective view showing the construction of a dye pack playing the role of a container for the third embodiment.

Referring to FIG. 14, the construction of the dye pack 110 is first explained.

The dye pack 110 has three separate tanks, that is a Y-tank 111, an M-tank 112 and a C-tank 113, in which the above-mentioned particulate vaporizable dyes Y, M and C are stored, respectively. The dye pack 110 is removable for exchange and has a sealed structure to prevent intrusion of humidity or foreign matter or vaporization of the dyes under the effect of ambient light. However, the dye pack 110 also has a fine pore area 114 to permit air venting.

As the dye pack 110 is secured to the dye supply pre-stage section 120 shown in FIG. 13 by set screws 104*a* to 104*d*, the particulate vaporizable dyes are fed onto the dye supply pre-stage section 120 via a Y-dye outlet 115, an M-dye outlet 116 and a C-dye outlet 117, each in the form of protrusions, provided on the bottom of the pre-stage section 120.

Figure 15:
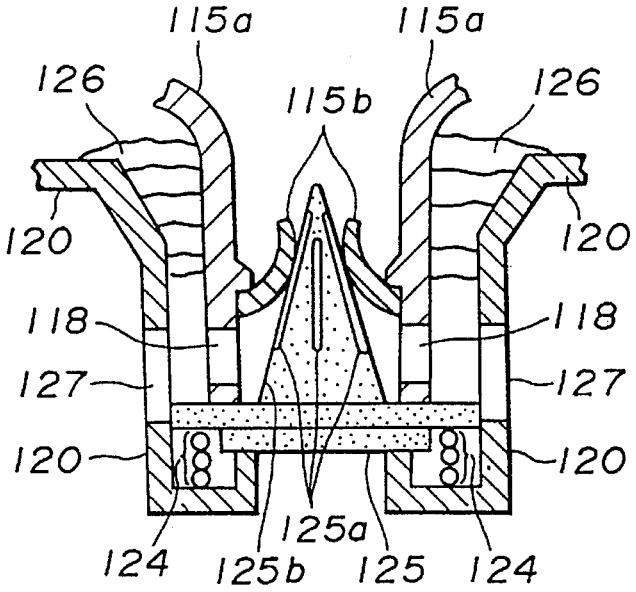
FIG. 15 is a cross-sectional view showing a connecting portion between a dye feed pre-stage and the dye pack playing the role of a container for the third embodiment.

These dye outlets 115 to 117, in the form of protrusions, are introduced into a Y-dye reception opening 121, an M-dye reception opening 122 and a C-dye reception opening 123, formed in the dye supply pre-stage section 120 shown in FIG. 13. This state is shown in the cross-sectional view of FIG. 15. Although only the structure of a connecting portion between the Y-dye outlet 115 shown in FIG. 14 and the Y-dye receiving opening 121 shown in FIG. 13 is shown in the cross-sectional view in FIG. 15, the same structure is used for connecting the M-dye outlet 116 and the C-dye outlet 117 and that between the Cdye outlet 117 and the M-dye outlet 123.

First, a simplified resilient valve 115*b* is provided at a tubular portion 115*a* of the dye outlet 115 to permit the dye pack 110 to be hermetically sealed under the usual condition of the dye pack in which the dye pack is not mounted onto the dye supply pre-stage section 120. A spring section 124 and a lid 125 having a conical portion 125*b* formed with flutes 125*a* is provided in the vicinity of the dye receiving opening 121 of the dye supply pre-stage section 120 to permit the pre-stage section 120 to be hermetically sealed under the usual condition in which the dye pack 110 is not mounted in position on the pre-stage section 120.

When the dye pack 110 is mounted on the pre-stage section 120, the lid 125 fitted with the conical portion 125*b* formed with the flutes 125*a* is thrust upwards for opening slit-shaped openings 118 and 127 formed in the pre-stage section 120 and the dye outlet 115. At this time, the conical portion 125*b* of the lid 125 formed with the flutes 125*a* thrusts the valve 115*b* at the dye outlet 15 open, so that the particulate vaporizable dye contained in the dye pack 110 descends along the flutes 125*a* of the lid 125 which has thrust open the valve 15*b* of the dye outlet 115. The dye is then guided via the slit-shaped openings 18, 27 towards the dye supply pre-stage section 120. A resilient member 126 is mounted in the vicinity of the dye supply pre-stage section 120 for maintaining a hermetically sealed structure after connection of the pre-stage section 120 to the dye pack 110. The flutes 125*a* may be designed to allow passage only of the particulate dye having a size not larger than a predetermined size.

Figure 16:
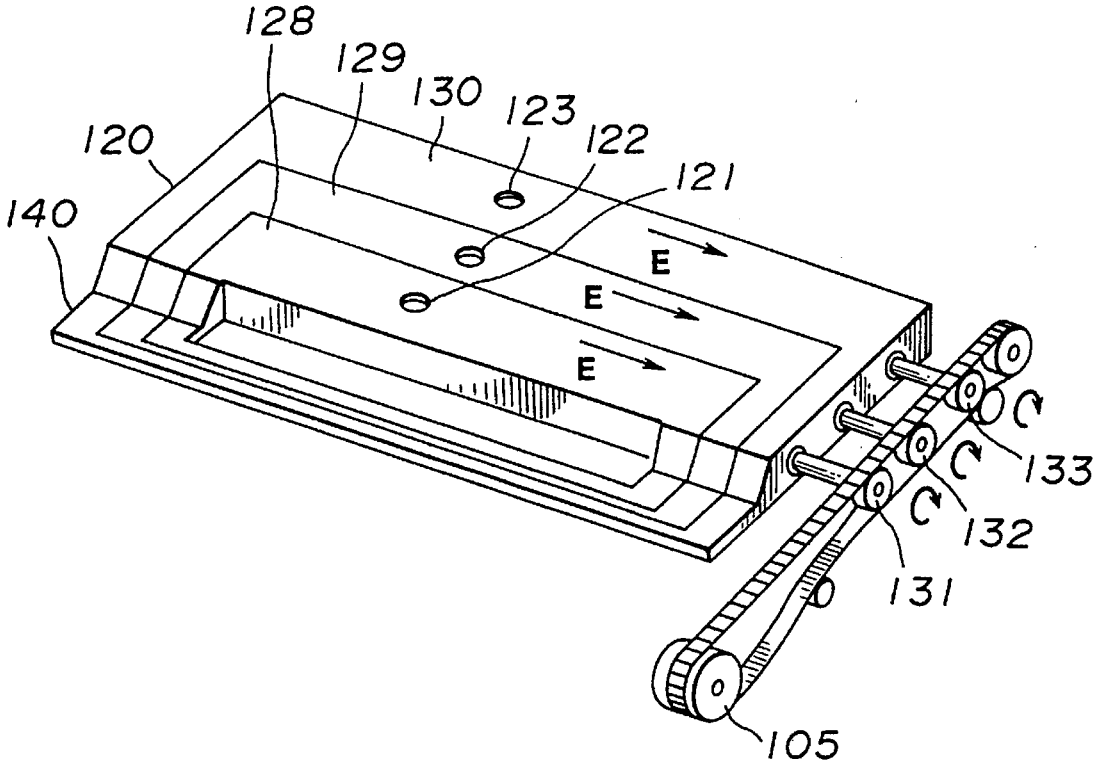
FIG. 16 is a perspective view showing the dye supply pre-stage of the third embodiment.
Figure 17:
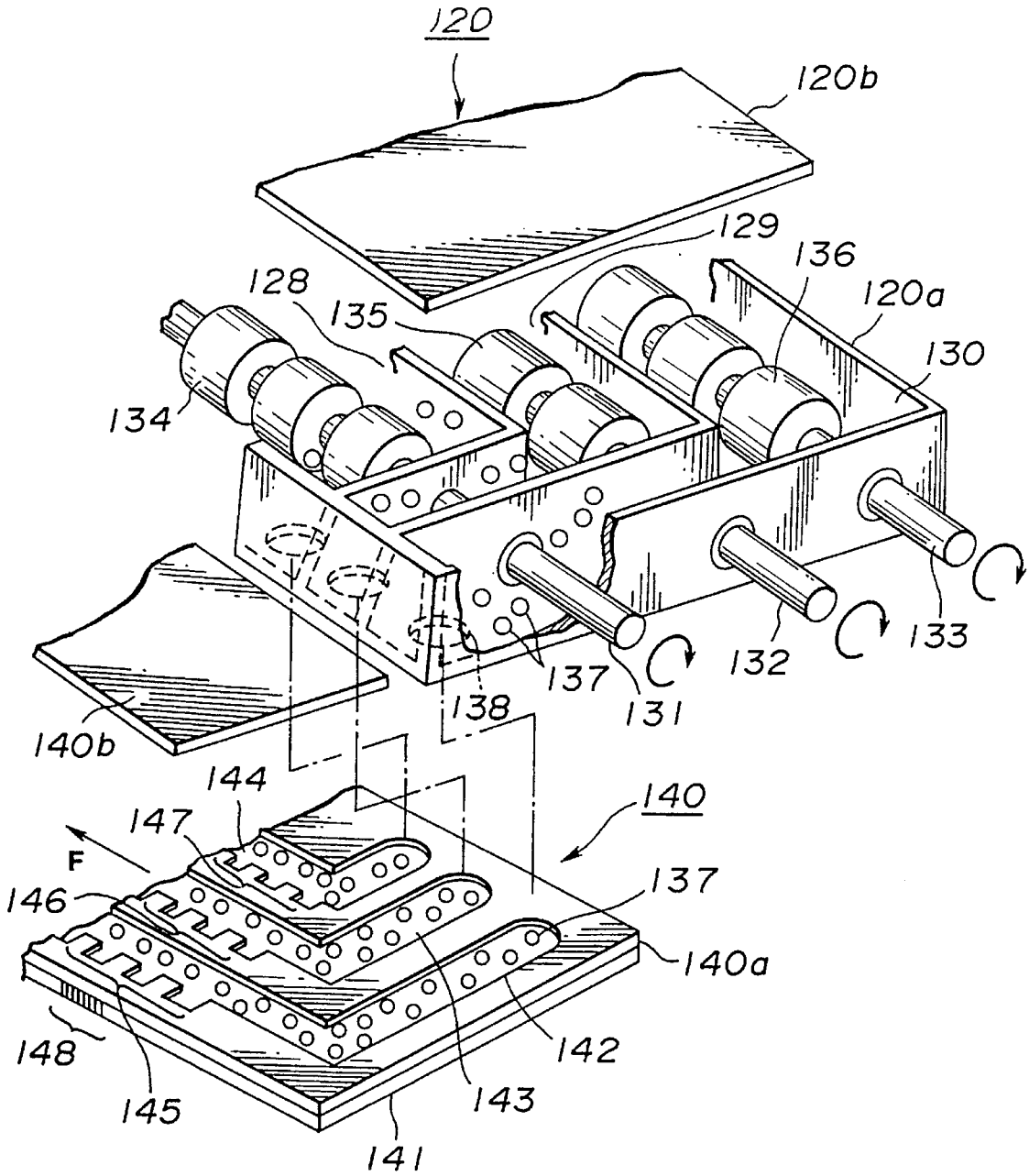
FIG. 17 is a perspective view showing an inner structure of a feed supply post-stage and the feed supply pre-stage for the third embodiment.

Referring to FIGS. 16 and 17, the constructions of the dye supply pre-stage, the dye supply post-stage section 140 and vaporizing sections are hereinafter explained.

The dye supply pre-stage section 120 separately receives the particulate vaporizable dyes Y, M and C, separately contained in the Y-tank 111, M-tank 112 and in the C-tank 113 of the dye pack 110, shown in FIG. 14, in its Y-dye supply pre-stage section 128, M-dye receiving pre-stage section 129 and in the C-dye receiving pre-stage section 130, respectively, by virtue of the connection between the Y-dye outlet 115, M-dye outlet 116 and the C-dye outlet 117 of the dye pack 110, on one hand, and the Y-dye receiving opening 121, M-dye receiving opening 122 and the C-dye receiving opening 123, on the other hand. The particulate vaporizable dyes Y, M and C, supplied to the Y-dye supply pre-stage section 128, M-dye receiving pre-stage section 129 and the C-dye receiving pre-stage section 130, are rollingly moved along the direction shown by arrow E.

Such rolling movement of the particulate vaporizable dyes Y, M and C is rendered possible by the internal structure of the dye supply pre-stage section 120 as shown in FIG. 17, in which the internal structure of the Y-dye supply pre-stage section 128, M-dye supply pre-stage section 129 and the C-dye supply pre-stage section 130 is shown with a lid 120*b* of the pre-stage section 120 detached from a casing section 120*a*.

The Y-dye supply pre-stage section 128, M-dye receiving pre-stage section 129 and the C-dye receiving pre-stage section 130 are provided with feed screws 134, 135 and 136, respectively, which are formed in shafts 131, 132 and 133, respectively. These feed screws 134 to 136 are rotated about their own axes by a rotational torque which the shafts 131 to 133 receive from a gear 105, shown in FIG. 16, which is rotated under a driving force of feeding the photographic paper 21. Thus, the particulate vaporizable Y-dye 137, for example, is rollingly moved in the direction shown by arrow E in FIG. 16.

The particulate vaporizable Y-dye, for example, is fed onto the dye supply post-stage section 140 via through-holes 138. The internal structure of the post-stage section 140 is also shown in FIG. 17.

The dye supply post-stage section 140 is formed by stacking a plate 140*a*, formed of a glass material having low light absorbance and a low heat conductivity, on a plate 141 formed with a number of slits 148, each being several μ microns in diameter. The post-stage section 140 also includes a Y-dye supplying patterned groove 142, about 50 to 80 μm deep, for conducting the particulate vaporizable dye 137 fed via the through-holes 140. An M-dye supplying patterned groove 143 and a C-dye supplying patterned groove 144 are formed in a similar manner. These grooves 142, 143 and 144 are each formed with a plurality of vaporizing sections 145, 146 and 147, respectively.

The particulate vaporizable Y-dye 137 is fed in a direction shown by arrow F in the Y-dye supplying groove 142, for example, so as to be stored in the vaporizing section 145. The laser light transmitted through a lid 140*b* formed of a glass material exhibiting high transmittance is radiated on the particulate vaporizable Y-dye 137 stored in the vaporizing section 145.

Each of the vaporizing sections 145 to 147, irradiated with the laser light from a laser block 150 via the lid 140*b*, absorbs about one half of the volume of the laser light to transform it into heat for vaporizing the dye. The remaining one-half of the laser light is used for heating the reception layer on the photographic paper 1.

The dye vaporized by the vaporizing sections 145 to 147 is permeated towards below through the vaporizing openings 148 formed in the plate 141 under the capillary phenomenon so as to be transcribed on the receptor layer of the photographic plate 21.

Each of the particulate dyes which has not been stored in the vaporizing sections 145 to 147, that is not vaporized, is circulated via the grooves 142, 143 and 144 of the dye supply post-stage section 140 to the dye supply pre-stage section 120.

Figure 18:
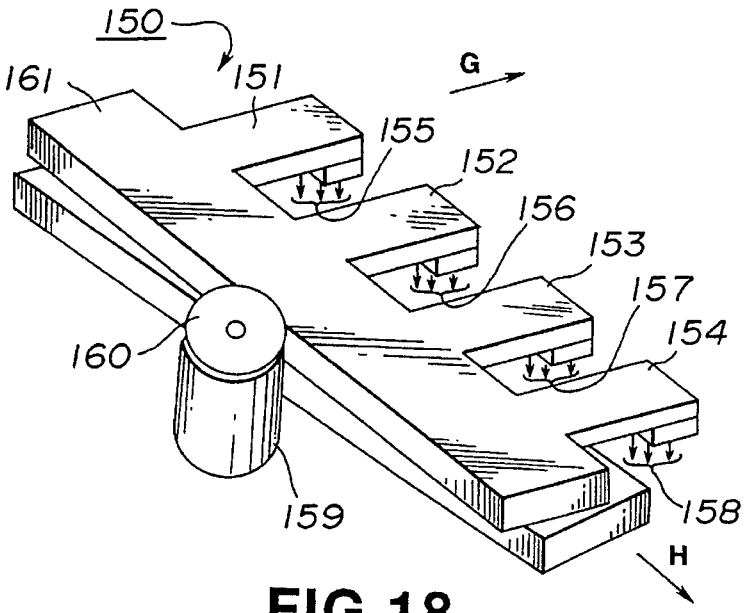
FIG. 18 is a schematic perspective view showing essential portions of a laser block according to the third embodiment.

The laser block 150 is explained by referring to FIG. 18.

The laser block 150 has its arms 151, 152, 153 and 154 secured to a base section 161. Each of these arms 151 to 154 is provided with a plurality of semiconductor laser devices so that several laser light beams 155, 156, 157 and 158 are radiated simultaneously from these arms 151 to 154 in a downward direction, that is towards the vaporizing sections 145, 146 and 147.

The driving of the laser block 150 in the direction of arrow G is controlled by e.g. a rotary actuator 159, such as an electric motor, so that the laser block is advanced and retracted each in e.g. three stages via an offset cam 160. The driving of the rotary actuator 159 is carried out in a timed relation to the Y, M and C color signals.

The driving of the laser block 150 in the direction of arrow H is controlled e.g. by a feed mechanism or by a linear motor. This enables the number of the laser devices to be reduced to lower the costs and to improve the yield. The driving in the direction of arrow H or in the transverse direction is carried out in a timed relation to the color dot signals.

With the sublimation type printer according to the third embodiment, the particulate vaporizable dyes Y, M and C, contained in separate tanks of the dye pack 110, are transported in one direction by the dye supply pre-stage section 120 up to the vaporizing sections 145, 146 and 147 of the dye supply post-stage 140, so as to be vaporized in the vaporizing sections 145, 146 and 147 by the vaporizing heat provided by the laser light for transcription onto the photographic paper 21. Thus, there is no necessity of providing an ink ribbon or a thermal head and the device may be reduced in size while dye exchange may be facilitated. Besides, any excess dye left in the vaporizing sections 145, 146 and 147 may be circulated for achieving saving to assure printing with high picture quality.

Figure 19:
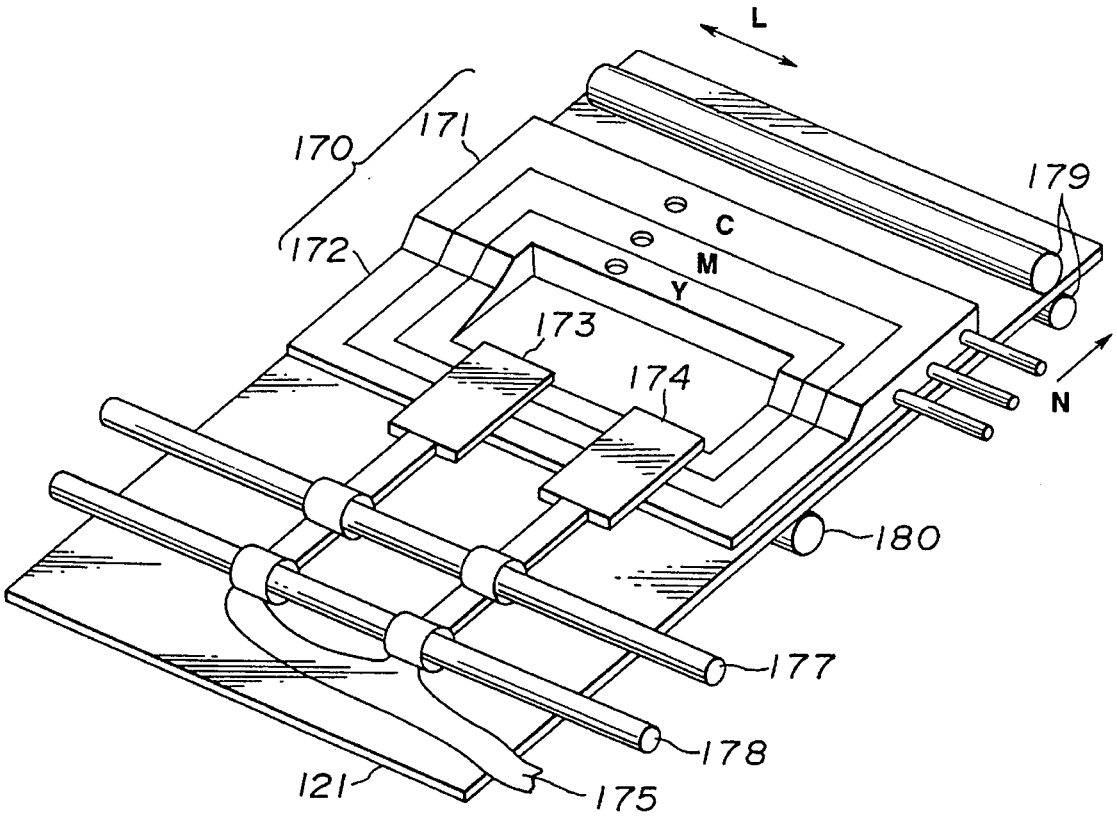
FIG. 19 is a schematic perspective view showing a fourth embodiment.

Referring to FIG. 19, a fourth embodiment of the present invention concerning the printing device is explained.

In the present fourth embodiment, similarly to the above-described third embodiment, the particulate vaporizable dye is employed and vaporized so as to be thermally transcribed onto the photographic paper. Thus, the device of the present fourth embodiment is hereinafter referred to as a sublimation type printer.

Although the dye pack in the sublimation type printer is not shown in FIG. 19 showing the schematic arrangement of the printer, the construction of the printer and the manner of feeding the dye to the dye supply pre-stage section 171, corresponding to the dye supply pre-stage section 120 according to the third embodiment, is similar to the sublimation type printer according to the third embodiment. The manner of transporting the dye within the dye supply pre-stage section 171 is similar to that performed with the sublimation type printer according to the third embodiment.

With the sublimation type printer according to the fourth embodiment, a head block 170, comprised of a dye pack, not shown, the dye supply pre-stage section 171 and a dye-supply post-stage section 172 having a vaporizing section, not shown, is fixed, and laser blocks 173, 174, for radiating the laser light onto the head block 170, are moved for performing the printing on the photographic paper 21. The laser blocks 173, 174 are of identical construction.

Figure 20:
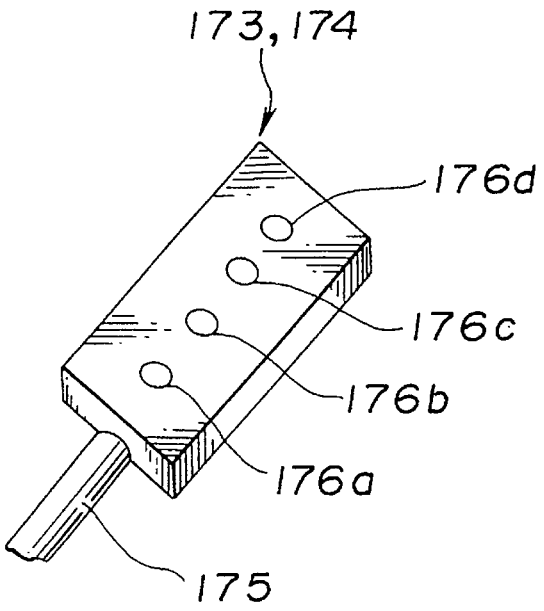
FIG. 20 is a reverse side view showing a laser block for the second embodiment.

The laser blocks 173, 174, the back sides of which are shown in FIG. 20, are each formed with Y-printing laser outgoing openings 176*a*, M-printing laser outgoing openings 176*b*, C-printing laser outgoing openings 176*c* and outgoing openings for a laser for photographic paper 176*d*, and are connected to a signal line for laser 175. The laser blocks 173, 174 are moved by a laser block feed shaft 177 and a laser block supporting shaft 178 so as to be moved in the line direction as indicated by an arrow L. At this time, the Y-printing laser outgoing openings 176*a*, M-printing laser outgoing openings 176*b*, C-printing laser outgoing openings 176*c* and the outgoing openings for laser for photographic paper 176*d*, of the laser blocks 173 and 174 are positioned directly above the vaporizing sections formed in the dye supply post-stage section 172 of the head block 170.

Referring to FIGS. 19 and 20, the operation of the sublimation type printer according to the present fourth embodiment is hereinafter explained.

The photographic paper 21 is fed by a photographic paper driving roll 179 is the paper feed direction shown by arrow N. The photographic paper 21 is pressed by a printing paper supporting roll 180 into intimate pressure contact with the head block 170.

The photographic paper 21 is introduced into a space between the head block 170 and the photographic paper supporting roll 180. The vaporizing sections of the head block 170 are arrayed in alignment with the printing direction indicated by arrow N, with the number of each of the vaporizing sections in the head block 170 along the line direction indicated by arrow L being the same as the number of pixels. The laser light radiating openings in the laser blocks 173, 174 are set so as to be in register with the vaporizing sections in the paper feed direction or printing direction, and are arrayed at the number rate of 1:1 or 1:1/n in the line direction. If the laser light radiating openings are arranged at the number rate of 1:1 with respect to the vaporizing sections, the laser radiating openings may be provided in the laser block 170. Even if the laser light radiating openings are arranged at the number rate of 1:n with respect to the head block 170, the laser radiating openings may be provided in the laser block at the number rate of 1/n.

The vaporizable dyes in the vaporizing sections within the head block 170 are vaporized by the laser light corresponding to picture signals from the laser blocks 173 and 174 so as to be transcribed onto the photographic paper 21. If the number of the laser radiating openings bears a ratio of 1/n with respect to the number of the vaporizing sections, the laser blocks 173, 174 are moved in the line direction indicated by arrow N a distance corresponding to the number of pixels to complete one line. The same operation is performed for the dyes M and C. The Y, M and C dyes are printed sequentially for three printing start and end lines and simultaneously for the remaining lines. After the end of printing for one line, the photographic paper 21 is fed by one line by the printing paper driving roll 179.

Thus, with the sublimation type printer according to the present fourth embodiment, since the head block 170 is fixed, and the laser blocks 173, 174, having the respective laser radiating openings aligned with the vaporizing sections, are moved, for vaporizing the particulate vaporizable dyes, moved in one direction by the dye supply pre-stage section 171, by the laser light corresponding to the picture signals, for transcription onto the photographic paper 21, there is no necessity of providing an ink ribbon or a thermal head, so that the device may be reduced in size and dye exchange may be simplified. In addition, since any excess dye left in the vaporizing sections 145, 146 and 147 may be circulated for achieving the saving in the dye to assure the printing with high picture quality.

It is noted that, with the sublimation type printers according to the third and fourth embodiments, the particulate vaporizable dye is contained in the dye pack and used in circulation. Alternatively, the particulate vaporizable dye contained in the dye pack may also be deposited in the dye supply pre-stage section on the surfaces of spherical-shaped beads, each being several microns in diameter, so as to be moved in one direction for being supplied to the vaporizing sections formed in the dye supply post-stage section. The dye may also be circulated in the manner as described above.

Figure 21:
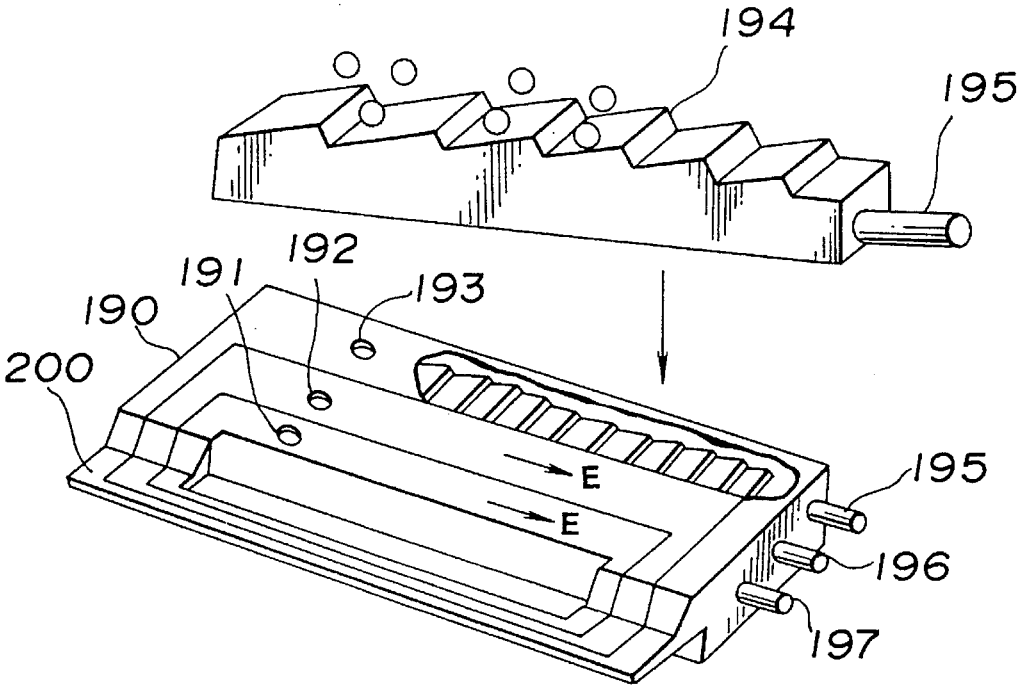
FIG. 21 is a perspective view showing a modified inner structure of a dye supply pre-stage.

The beads, on the surfaces of which the particulate vaporizable dye is deposited, may also be moved in one direction by transverse vibrations as shown in FIG. 21. In such case, the particulate vaporizable dye supplied from the dye pack, herein not shown, via dye reception openings 191, 192 and 193 is moved through the inside of the dye supply pre-stage section 190 by a transverse oscillation generating device 194, so as to be supplied to a dye supply post-stage section 200 having the vaporizing sections formed therein. The transverse oscillation generating device 194 generates transverse oscillation by a shaft 195. Shafts 196, 197 are also the shafts for generating transverse oscillation in transverse oscillation generating devices, not shown, having the same construction as the transverse oscillation generating device 194.

The beads, on the surfaces of which the particulate or powdered vaporizable dye is deposited, may also be moved by pneumatic feed means, in a manner not shown.

On the other hand, if the laser light radiated on the sublimation type printers according to the third and fourth embodiments is radiated in each laser block with equalized intensity distribution, as in the case of the sublimation type printer according to the first and second embodiments, it becomes possible to equalize the transformation into heat in the light absorbing layer and to maximize the energy conversion efficiency.

Meanwhile, with the sublimation type printers according to the first to fourth embodiments, the vaporized dye is deposited on the photographic paper 21 for printing. In any of these embodiments, the receptor layer on the surface of the photographic paper 21 may be heated to aid in deposition of the vaporized dye.

Figure 22:
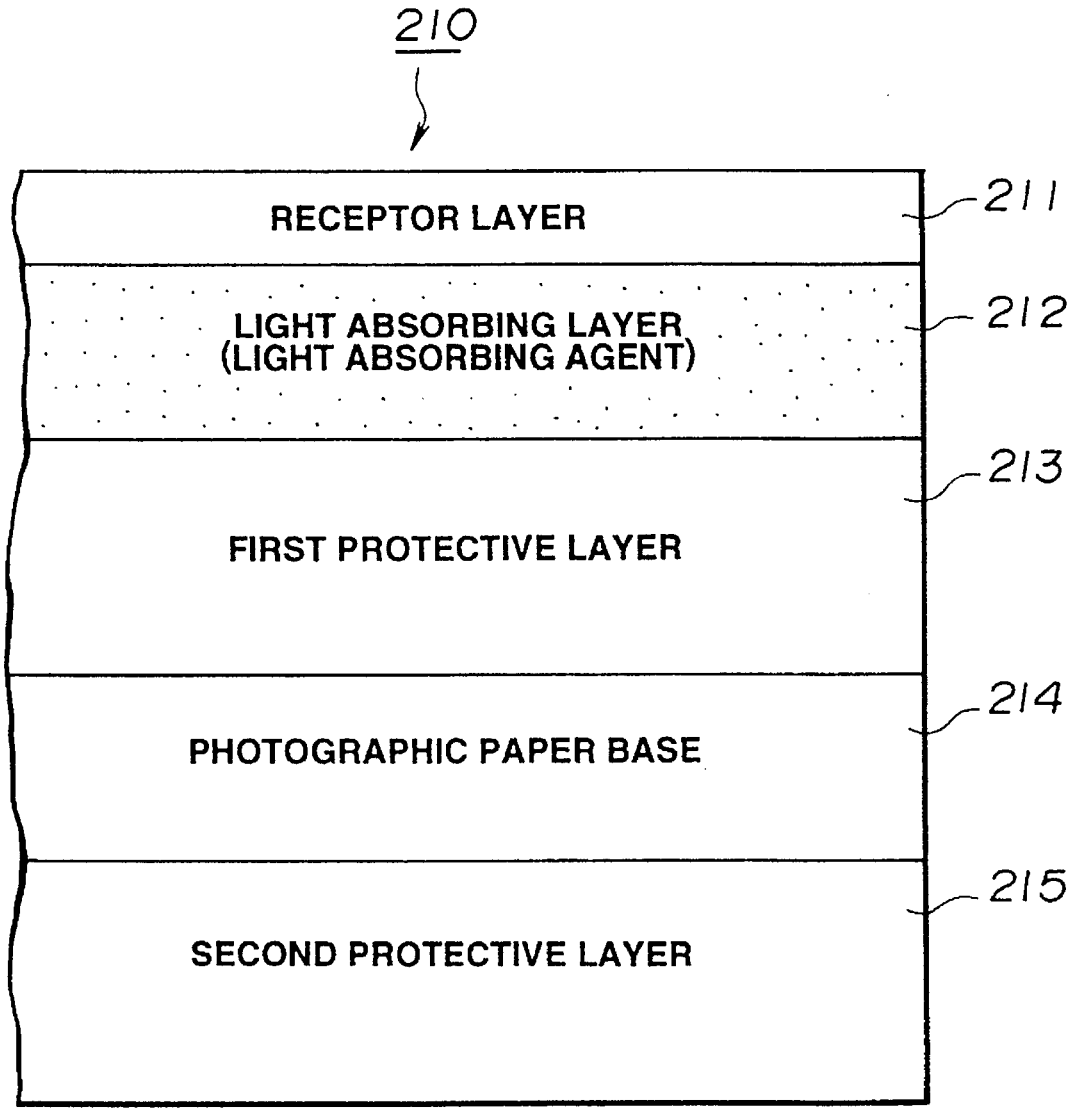
FIG. 22 is a perspective view showing a fifth embodiment.
Figure 23:
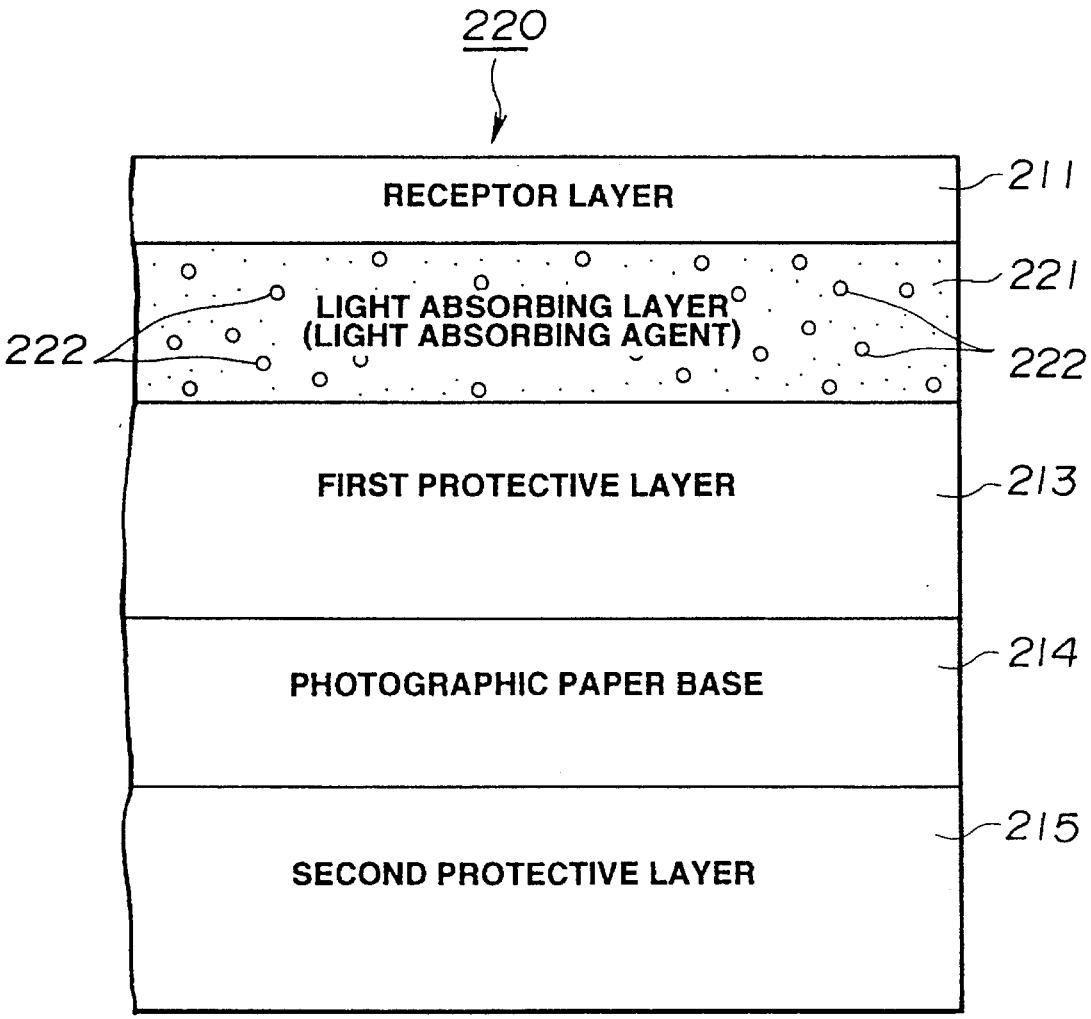
FIG. 23 is a perspective view showing a sixth embodiment.

Referring to FIGS. 22 and 23, fifth and sixth embodiments of the present invention, relating to the photographic paper capable of heating the receptor layer efficiently, will be explained. In the following, the fifth and sixth embodiments are referred to as a photographic paper according to the fifth embodiment and a photographic paper according to the sixth embodiment, respectively.

Referring first to FIG. 22, the photographic paper according to the fifth embodiment includes, viewing from the upper side, a receptor layer 211 which is formed of a resin, such as cellulose resin, and which is capable of transmitting the light therethrough and absorbing the vaporizable dye, a light absorbing layer 212 formed of a light absorbing agent capable of efficiently absorbing the laser light and generating the heat efficiently, a first protective layer 213 formed of a highly heat-resistant and non-hygroscopic material, such as polypropylene, a photographic paper base 214 formed e.g. of polyethylene terephthalate, and a second protective layer 215 having properties similar to those of the first protective layer 213 and playing the role of preventing the warping of the photographic paper of the fifth embodiment 210, these layers 211 to 215 being bonded and stacked one upon the other with the aid of an adhesive, not shown.

The receptor layer 211 absorbs the dye vaporized under the heat of vaporization generated by a laser light from a printing device, not shown. That is, a semi-transparent heating member, provided within a vaporizing section of the printing device, not shown, generates the heat efficiently by the laser light to vaporize the vaporizable dye. The vaporized dye is released via the vaporizing openings provided in the vaporizing section so as to be deposited on the receptor layer 211.

Part of the laser light is transmitted through the semi-transparent heating member so as to be radiated on the photographic paper 210. Since the receptor layer 211 formed on the surface of the photographic paper transmits the light, the laser light reaches the light absorbing layer 212.

The light absorbing layer 212 is formed e.g. of a light absorbing agent, such as an IR absorber, and hence absorbs the laser light efficiently, so that heat may be generated efficiently. The heat generated in the light absorbing layer 212 is transmitted to the receptor layer 211 and tends to be transmitted to the first protective layer 213. However, since the first protective layer 213 is formed of a highly heat-resistant and low heat conducting material, such as polypropylene, it is transmitted only to the receptor layer 211 without being transmitted to the first protective layer 213. Thus the receptor layer 211 is heated efficently by the light absorbing layer 212.

In general, the light absorbing agent, used for absorbing the light, reflects the light if the agent has a white hue. For this reason, the light absorbing layer 212 has a pale color hue, instead of a white hue. Such color hue of the light absorbing layer 212 deteriorates the quality of the printed picture. For this reason, the light absorbing layer 212 needs to be whitened after printing. For whiting the light absorbing layer 212 after printing, the light absorbing agent, such as the above-mentioned IR light absorber, which has its color extinguished on irradiation with a laser light, is employed.

As such light absorbing agent, a functional near-infrared ray absorbing coloring matter, manufactured by SHOWA DENKO KK under the trade name of IR 820B, is employed. This functional near-infrared ray absorbing coloring matter IR 820B, exhibits an absorption maximum for the light having a wavelength of 825 nm, such that, if it is used along with an ammonium salt of organic boron, such as tetrabutyl ammoniumbutyl triphenyl borate, in a solution, it absorbs the near infrared rays to extinguish the color.

Thus, with the photographic paper 210 of the fifth embodiment, the receptor layer 211 may be directly heated by the light absorbing layer 212, while the pale color of the light absorbing layer 212 is extinguished by the laser light, so that the printed picture is not degraded in picture quality.

The construction of the photographic paper according to the sixth embodiment of the present invention is explained.

The construction of the photographic paper according to the sixth embodiment shown in FIG. 23 is approximately similar to that of the above-described first embodiment shown in FIG. 22, so that similar parts or components are depicted by the same numerals and the corresponding description is omitted for simplicity.

The photographic paper 220 of the present sixth embodiment includes, viewing from the upper side, a receptor layer 211, a light absorbing layer 221, a first protective layer 213, a photographic paper base 214 and a second protective layer 215, bonded and stacked together with the aid of an adhesive, not shown, applied between the adjacent layers.

The light absorbing layer 221 efficiently absorbs a laser light, not shown, for generating the heat efficiently, as in the case of the photographic paper of the fifth embodiment. The receptor layer 211 is heated by the light absorbing layer 221.

With the photographic paper 220 according to the sixth embodiment, a capsule having an enclosed whitening agent is destroyed by the laser light for permeating the whitening agent for whitening the light absorbing layer 221.

That is, the light absorbing layer 221 contains a light absorbing agent and a whitening agent, such as titanium oxide, enclosed in a number of capsules 222 formed e.g. of polyurea, as shown in FIG. 23. The capsule 222 is thermally destroyed by the laser light for permeating the whitening agent into the light absorbing agent for extinguishing the color of the light absorbing agent for whitening the light absorbing layer 221.

The whitening agents may be enumerated by titanium oxide, zinc oxide or calcium oxide.

The capsule for enclosing the whitening agent may be formed of condensates, such as polyurea or polyurethane, homopolymers such as polyvinyl alcohols or waxes, such as paraffin or lipid.

Thus, with the photographic paper 220 of the present sixth embodiment, the receptor player 211 may be heated directly by the light absorbing layer 221 to assure a high heat efficiency, while the light absorbing layer 221 is whitened by the whitening agent which is distributed on thermal capsule destruction to maintain a high picture quality of the printed picture.

With the use of the photographic paper according to the fifth or sixth embodiment, the light absorbing layer 211 or 221 of the photographic paper 210 or 220 may be whitened by the laser light which has its output increased by employing a transparent section of vaporizing sections 51, 52, corresponding to the transparent section 22 in FIG. 1, if the above-mentioned typical printing mechanism shown in FIG. 7 provided with the sublimation printer according to the first embodiment is employed. In such case, the laser light employed in the vaporizing sections 51, 52 is of a four-beam construction.

Figure 9:
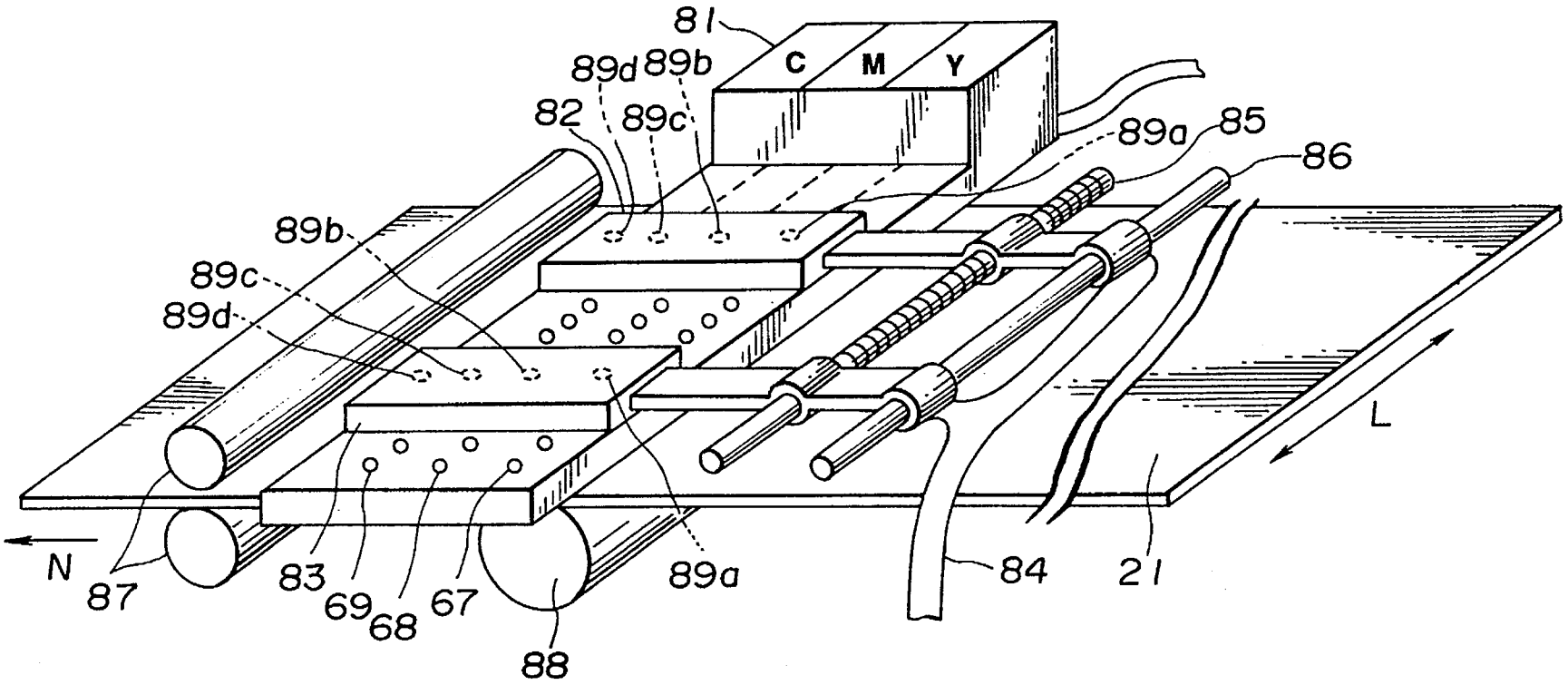
FIG. 9 is a perspective view showing a typical printing mechanism for the second embodiment.

With the illustrative printing mechanism, provided with the sublimation type printer according to the above-mentioned second embodiment, as shown in FIG. 9, a laser light which has its output increased is radiated after the end of printing on the transparent section of the head block 81, corresponding to the transparent section 70 of FIG. 8, via the laser radiating opening 89*d* for photographic paper formed in the laser locks 82, 83, for whitening the light absorbing layers 211 or 221 of the photographic papers 210 or 220, respectively.

With the sublimation type printer according to the third embodiment, shown in FIG. 13, the light absorbing layers 211 or 221 of the photographic paper 210 or 220 may be whitened by one-half of the laser light from the laser block 150.

With the sublimation type printer according to the fourth embodiment, shown in FIG. 19, the light absorbing layers 211 or 221 of the photographic paper 210 or 220 may be whitened by radiating a laser light of an increased output via the laser radiating opening for photographic paper 176*d*, formed in the laser block 173 or 174 after the end of printing.

Referring to FIGS. 8 and 9, the operation of the sublimation type printer of the second embodiment up to the whitening of the light absorbing layer 211 or 221 is explained.

With the sublimation type printer according to the second embodiment, the vaporizable dye contained in e.g. the dye tank 61 is liquefied or melted by being heated by the first heating member 71 of the entrance section 64. The vaporizable dye thus liquefied is moved by the capillary phenomenon of the entrance section 64 onto the vaporizing section 67. The entrance section 64 heats the liquefied vaporizable dye by the first heating member and maintains its temperature. The liquefied vaporizable dye, moved onto the vaporizing section 67, is vaporized under the heat of vaporization from the second heating member which efficiently generates heat by the laser light radiated from the laser block 82 or 83. The vaporized dye is passed through the vaporizing openings in the vaporizing section 67 by the diffusion phenomenon so as to be deposited on the receptor layer 211 or 211 of the photographic paper 210 or 220. At this time, the light absorbing layers 211 or 221 of the photographic paper 210 or 220 is heated by the laser light transmitted through the semi-transparent second heating member of the vaporizing section 67 for heating the receptor layer 211 or 211 to aid in transcription of the vaporized dye. Subsequently, the laser light transmitted through the transparent section 70 thermally destroys the light absorbing agent of the light absorbing layer 211 or 221 or the capsules 222 enclosing the whitening agent for whitening the color hue of the light absorbing layer 211 or 221. The order of the intensity or temperature of the laser light may be expressed by (the laser light for dye transcription)<(laser light for heating the receptor layer)<(laser light for whitening the light absorbing layer).

It is noted that the photographic paper according to the present invention is not limited to the above-described fifth and sixth embodiments. For example, the receptor layer, light absorbing layer, first protective layer, photographic paper base and the second protective layer may be formed of materials different from those given above if these layers are endowed with the properties required of them. The same may be said of the light absorbing agents, whitening agents or capsules provided in the light absorbing layer.

The whitening of the light absorbing layer may also be realized by the combination of thermal destruction of the light absorbing agent and thermal destruction of the whitening agent enclosing capsules brought about by the laser light.

What is claimed is:

1. A printing device for thermal transcription of a vaporizable dye onto a photographic paper comprising:

containing section means for containing a vaporizable dye, supplying section means for supplying the vaporizable dye supplied from said containing section, and vaporizing section means for vaporizing the vaporizable dye supplied by said supplying section means into vapor form and for thermally transcribing the vaporized dye onto said photographic paper, wherein the vaporizable dye contained in said containing section means is deposited on spherical-shaped bodies disposed in said containing section, and wherein the vaporizable dye supplied by said supplying section means to said vaporizing section means is also deposited on spherical-shaped bodies disposed in said vaporizing section.

2. The printing device as claimed in claim 1, wherein the vaporizable dye contained in said containing section is in a particulate form and wherein the vaporizable dye supplied by said supplying section to said vaporizing section is also in a particulate form.

3. The printing device as claimed in claim 1, wherein the supplying section includes means for circulating excess vaporizable dye.

4. The printing device as claimed in claim 1, wherein the supplying section includes a plurality of beads which circulate excess vaporizable dye.

5. The printing device as claimed in claim 1, further includes a source of laser light wherein the supplying section includes means responsive to laser light from said source of laser light to produce heat for vaporizing the vaporizable dye.

6. The printing device as claimed in claim 5, wherein the laser light has an equalized radiation intensity distribution.

7. A thermal transcription printing device comprising:

a powered dye tank in which powdered dye is stored;

an entrance section which is connected to said dye tank to receive dye therefrom;

a vaporizing section which is contiguous with said entrance section;

a heating member that is disposed in said entrance section and which has a portion which projects into said dye tank and which heats and liquifies the powdered dye in said dye tank, said heating member extending to said vaporizing section to as to conduct liquified dye thereto;

a semi-transparent light absorbing layer disposed in said vaporizing section, said light absorbing layer converting laser light which passes therethrough into heat, the heat produce by said semi-transparent light absorbing layer vaporizing the liquified dye which has been conducted into said vaporizing section by said heating member;

a source of laser light which selectively directs beams of laser light through said semi-transparent light absorbing layer;

vapor openings formed in a lower portion of said vaporizing section which diffuse vaporized dye from said vaporizing section to a receptor layer of a sheet of photographic paper, said vapor openings being arranged to transmit laser light from said source of laser light and which has passed through said semi-transparent light absorbing layer, to said photographic paper;

capillary means, disposed in said entrance section and associated with said heating member, for inducing dye which is liquified by said heating member to move under capillary action to said vaporizing section, said capillary means including a first plurality of beads which are fixedly disposed in said entrance section, which are arrayed along said heating member, and which are bonded to a lower surface of said heating member.

8. A thermal transcription printing device as claimed in claim 7, wherein lower portions of said first plurality of beads are covered with a protective layer.

9. A thermal transcription printing device comprising:

a powered dye tank in which powdered dye is stored;

an entrance section which is connected to said dye tank to receive dye therefrom;

a vaporizing section which is contiguous with said entrance section;

a heating member that is disposed in said entrance section and which has a portion which projects into said dye tank and which heats and liquifies the powdered dye in said dye tank, said heating member extending to said vaporizing section to as to conduct liquified dye thereto;

a semi-transparent light absorbing layer disposed in said vaporizing section, said light absorbing layer converting laser light which passes therethrough into heat, the heat produce by said semi-transparent light absorbing layer vaporizing the liquified dye which has been conducted into said vaporizing section by said heating member;

a source of laser light which selectively directs beams of laser light through said semi-transparent light absorbing layer;

vapor openings formed in a lower portion of said vaporizing section which diffuse vaporized dye from said vaporizing section to a receptor layer of a sheet of photographic paper, said vapor openings being arranged to transmit laser light from said source of laser light and which has passed through said semi-transparent light absorbing layer, to said photographic paper;

capillary means, disposed in said entrance section and associated with said heating member, for inducing dye which is liquified by said heating member to move under capillary action to said vaporizing section, said capillary means including a first plurality of beads which are fixedly disposed in said entrance section; and a second plurality of beads which are attached to a lower surface of aid semi-transparent light absorbing layer and which deposit vaporized dye on said photographic paper via a capillary effect produced between said second plurality of beads.

* * * * *